US010765240B2

(12) United States Patent
Glavin

(10) Patent No.: US 10,765,240 B2
(45) Date of Patent: Sep. 8, 2020

(54) SLEEPING BAG CLOSURE

(71) Applicant: Zenbivy LLC, Spokane, WA (US)

(72) Inventor: Michael Glavin, Spokane, WA (US)

(73) Assignee: ZENBIVY LLC, Spokane, WA (US)

( * ) Notice: Subject to any disclaimer, the term of this patent is extended or adjusted under 35 U.S.C. 154(b) by 277 days.

(21) Appl. No.: 16/041,827

(22) Filed: Jul. 22, 2018

(65) Prior Publication Data

US 2020/0022512 A1 Jan. 23, 2020

(51) Int. Cl.

| | |
|---|---|
| ***A47G 9/08*** | (2006.01) |
| ***A47G 9/04*** | (2006.01) |
| ***A47G 9/02*** | (2006.01) |

(52) U.S. Cl.

CPC ..... *A47G 9/086* (2013.01); *A47G 9/0223* (2013.01); *A47G 9/04* (2013.01)

(58) Field of Classification Search

CPC ..... A47G 9/08
USPC ..... 5/413 R, 413 AM, 482, 486, 496
See application file for complete search history.

(56) References Cited

U.S. PATENT DOCUMENTS

| | | | | |
|---|---|---|---|---|
| 2,656,540 | A * | 10/1953 | Stephenson | A41D 15/00 2/69.5 |
| 4,217,662 | A * | 8/1980 | Buchman | A47G 9/066 2/69.5 |
| 4,484,362 | A | 11/1984 | Asher | |
| 6,018,830 | A | 2/2000 | Howe | |
| 9,101,233 | B2 | 8/2015 | Benninger | |
| 2011/0173749 | A1 | 7/2011 | Martray | |
| 2014/0317844 | A1 | 10/2014 | Jacobsen et al. | |
| 2018/0192796 | A1 | 7/2018 | Glavin | |

FOREIGN PATENT DOCUMENTS

| | | |
|---|---|---|
| CN | 104921527 | 9/2015 |
| JP | 3195245 U | 10/2014 |
| KR | 10-2004-0100133 | 12/2004 |

OTHER PUBLICATIONS

International Search Report and Written Opinion for PCT/US2019/042325, dated Oct. 31, 2019. 15 Pages.

* cited by examiner

*Primary Examiner* — Fredrick C Conley
(74) *Attorney, Agent, or Firm* — Armstrong Teasdale LLP

(57) ABSTRACT

A quilt usable as a sleeping bag has inner and outer sets of fasteners arranged on slanted paths from each side edge to the bottom edge and fasteners along the bottom edge. The fasteners hold the quilt in a wrapped, overlapping arrangement. With the fasteners engaged, pulling a draw cord across the quilt bottom edge gathers the bottom edge and forms a closed, wrapped footbox of the sleeping bag. A sheet for use with a sleeping bag quilt include two sets of fasteners arranged to engage corresponding fasteners on the quilt to attach the quilt to the sheet in an expanded-footbox arrangement. Pulling a draw cord across the quilt bottom edge gathers the bottom edge and forms a closed, expanded footbox of the sleeping bag.

32 Claims, 11 Drawing Sheets

SLEEPING BAG CLOSURE

FIELD OF THE INVENTION

The field of the present invention relates to sleeping bags. In particular, disclosed herein are various closure arrangements for a sleeping bag.

SUMMARY

A first inventive article comprises a quilt usable as a sleeping bag, first and second pairs of discrete, mating bottom fastener elements, an inner set of one or more quilt fastener elements, an outer set of one or more quilt fastener elements, and a draw cord. The bottom fastener elements are attached to the quilt along the quilt bottom edge; one discrete bottom fastener element of the first pair is positioned between the discrete bottom fastener elements of the second pair, and one discrete bottom fastener element of the second pair is positioned between the discrete bottom fastener elements of the first pair. The bottom fastener elements thereby define a first quilt bottom edge lateral segment between the first pair of bottom fastener elements but not between the second pair of bottom fastener elements, a second quilt bottom edge lateral segment between the second pair of bottom fastener elements but not between the second pair of bottom fastener elements, and a quilt bottom edge central segment between both pairs of bottom fastener elements. The inner set of quilt fastener elements is attached to the quilt inner surface along at least a portion of a linear or curved inner quilt attachment path; the outer set of quilt fastener elements is attached to the quilt outer surface along at least a portion of a linear or curved outer quilt attachment path. The inner quilt attachment path extends from the first quilt lateral edge to the first quilt bottom edge lateral segment and defines on the quilt inner surface an inner quilt-overlap areal segment bounded by the inner quilt attachment path, the quilt bottom edge, and the first quilt lateral edge. The outer quilt attachment path extends from the second quilt lateral edge to the second quilt bottom edge lateral segment and defines on the quilt outer surface an outer quilt-overlap areal segment bounded by the outer quilt attachment path, the quilt bottom edge, and the second quilt lateral edge.

With the quilt wrapped in an overlapping footbox-wrapped arrangement, (i) the outer quilt-overlap areal segment faces a portion of the quilt inner surface, (ii) the inner quilt-overlap areal segment faces a portion of the quilt outer surface, (iii) each quilt fastener element of the inner set is substantially aligned with a corresponding, mating quilt fastener element of the outer set, and (iv) engagement of the corresponding mating quilt fastener elements of the inner and outer sets with each other retains at least a footward portion of the quilt in the overlapping footbox-wrapped arrangement. With the quilt wrapped in the overlapping footbox-wrapped arrangement, (i) the first pair of mating bottom fastener elements is positioned so as to engage each other, (ii) the second pair of mating bottom fastener elements is positioned so as to engage each other, and (iii) engagement of the first pair of bottom fastener elements with each other and engagement of the second pair of bottom fastener elements with each other retain at least the quilt bottom edge in the overlapping footbox-wrapped arrangement with the first and second quilt bottom edge lateral segments overlapping each other. The draw cord is engaged with the quilt bottom edge. With the quilt retained in the overlapping footbox-wrapped arrangement by engagement of the first pair of bottom fastener elements with each other, engagement of the second pair of bottom fastener elements with each other, and engagement of the corresponding quilt fastener elements of the inner and outer sets with each other, pulling the draw cord gathers the quilt bottom edge to form a closed, wrapped footbox of the sleeping bag.

A second inventive article comprises a sheet adapted for use with a sleeping bag, a first set of one or more sheet fastener elements, and a second set of one or more sheet fastener elements. The sheet is structurally arranged to be secured to a sleeping pad. The first and second sets of sheet fastener elements are attached to an outer surface of the sheet and structurally arranged along corresponding linear or curved first and second sheet attachment paths on the sheet outer surface. The first and second attachment paths are structurally arranged generally longitudinally along at least corresponding footward portions of respective first and second lateral edges of the sheet. The sheet fastener elements and the first and second sheet attachment paths are structurally arranged so as to enable (i) the first set of sheet fastener elements and a corresponding first set of quilt fastener elements of a quilt usable as a sleeping bag to engage each other, and (ii) the second set of sheet fastener elements and a corresponding second set of quilt fastener elements of the quilt to engage each other. With the quilt in an unwrapped arrangement with the first and second sets of quilt fastener elements disengaged from each other, and with the quilt positioned over the sheet with a quilt inner surface facing the sheet outer surface, (i) each quilt fastener element of the first set is substantially aligned with a corresponding, mating sheet fastener element of the first set, (iii) each quilt fastener element of the second set is substantially aligned with a corresponding, mating sheet fastener element of the second set, and (iv) engagement of the corresponding mating quilt and sheet fastener elements of the respective first sets with each other, and engagement of the corresponding mating quilt and sheet fastener elements of the respective second sets with each other, retain at least a footward portion of the quilt secured to the sheet in a footbox-expanded arrangement.

Objects and advantages pertaining to sleeping bags may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically; all features may not be shown in full detail or in proper proportion, certain features or structures may be exaggerated relative to others for clarity, and the drawings should not be regarded as being to scale. The embodiments shown are only examples, and should not be construed as limiting the scope of the present disclosure or appended claims.

DETAILED DESCRIPTION OF EMBODIMENTS

Figure 1B:
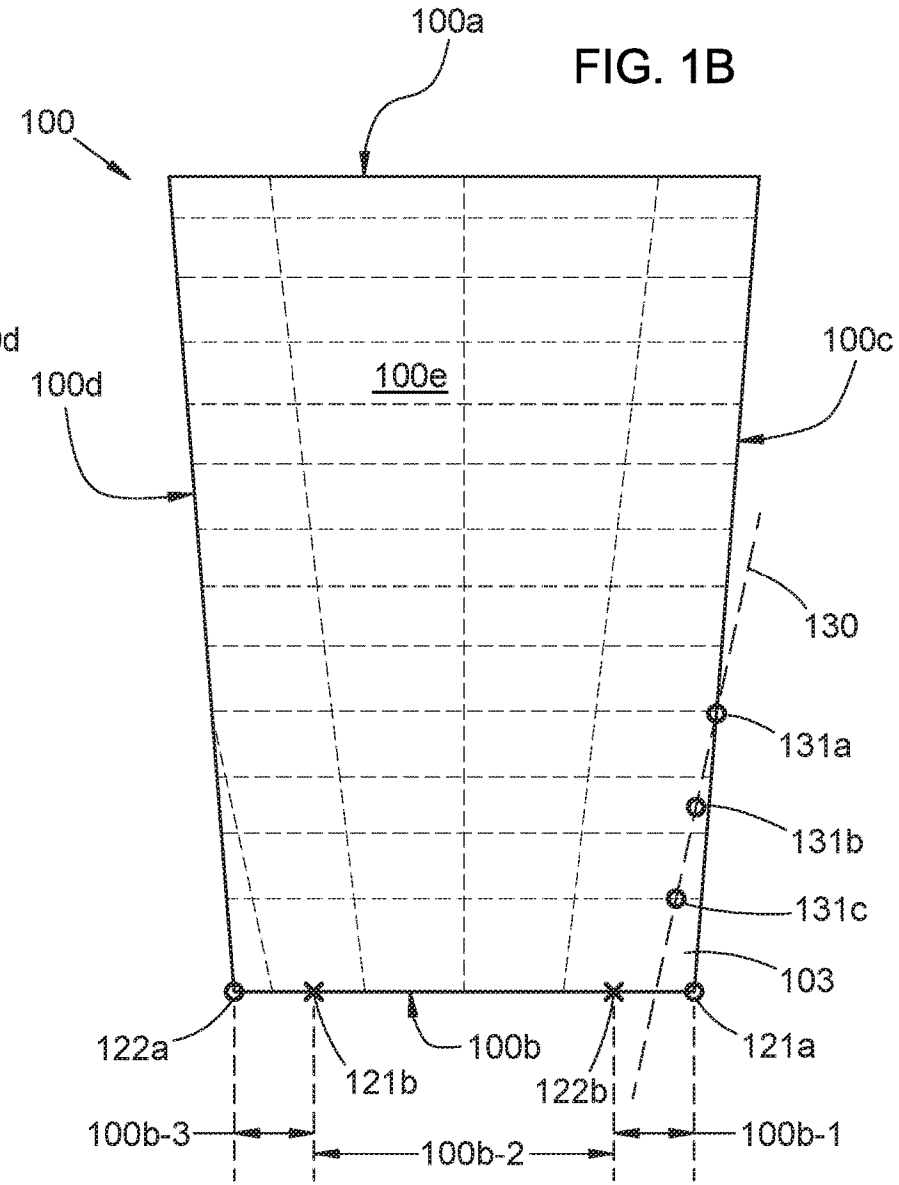
FIGS. 1A and 1B are schematic outer and inner views, respectively, of an example quilt of an inventive sleeping bag in a flattened arrangement.
Figure 1A:
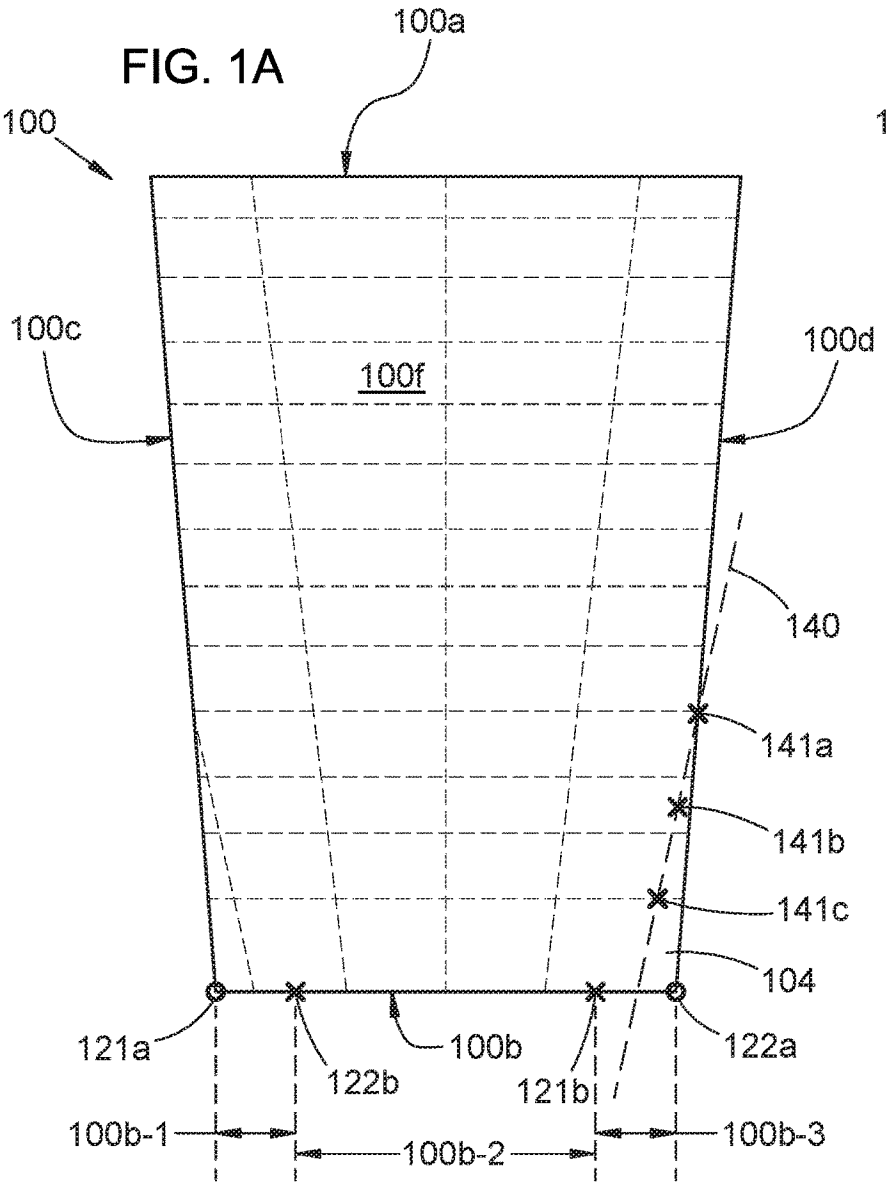

An inventive sleeping bag is illustrated schematically in FIGS. 1A/1B and includes a quilt 100 usable as a sleeping bag, a first pair of bottom fastener elements 121*a*/121*b*, a second pair of bottom fastener elements 122*a*/122*b*, an inner set of one or more quilt fastener elements 131, an outer set of one or more quilt fastener elements 141, and a draw cord 160 (omitted from FIGS. 1A/1B so as to avoid cluttering the drawing). If only a single inner quilt fastener element is present it is referred to herein as inner quilt fastener element 131; if multiple inner quilt fastener elements are present, they are referred to individually as inner quilt fastener elements 131*a*/131*b*/ . . . and collectively as inner quilt fastener elements 131. Similarly, if only a single outer quilt fastener element is present it is referred to herein as outer quilt fastener element 141; if multiple outer quilt fastener elements are present, they are referred to individually as outer quilt fastener elements 141*a*/141*b*/ . . . and collectively as outer quilt fastener elements 141.

The quilt has a headward top edge 100*a*, a footward bottom edge 100*b*, a first lateral edge 100*c*, a second lateral edge 100*d*, an outer surface 100*e*, and an inner surface 100*f*. In some examples, the quilt 100 is substantially trapezoidal with the top and bottom edges 100*a*/100*b* substantially parallel and the bottom edge 100*b* shorter than the top edge 100*a*; in other examples, the quilt 100 is substantially rectangular; other suitable shapes can be employed. The quilt 100 typically includes a quilted construction, i.e., two layers of fabric with some soft substance (e.g., wool, down, or other natural or synthetic insulation) between them and stitched in patterns or tufted through all thicknesses in order to prevent the filling from shifting (light dashed lines in the drawings indicate stitching). The stitching shown in the drawings notwithstanding, the term "quilt" is used generically herein to indicate any quilt-like or blanket-like article suitable for use as all or part of a sleeping bag; use of the term "quilt" is not intended to imply that the article so named must necessarily include quilting or be wholly or partly quilted, although such articles are encompassed by the term "quilt" as employed herein. The quilt 100 can be made in any suitable way from any one or more suitable materials. Any one or more materials (e.g., fabrics or insulators) suitable for constructing a conventional sleeping bag can be employed for constructing an inventive sleeping bag (or inventive sheet; see below). Examples of such materials include, but are not limited to: nylon, polyester, silk, cotton, taffeta, ripstop, pongee, flannel, microfiber, Gore-Tex, or fleece; natural down, synthetic insulation, or other insulating material; or metal-coated polymer film or other thermally shielding or thermally reflective material. If needed or desired, the quilt (and/or a sheet; see below) can include heating elements, e.g., electrical or chemical heating elements.

Figure 11B:
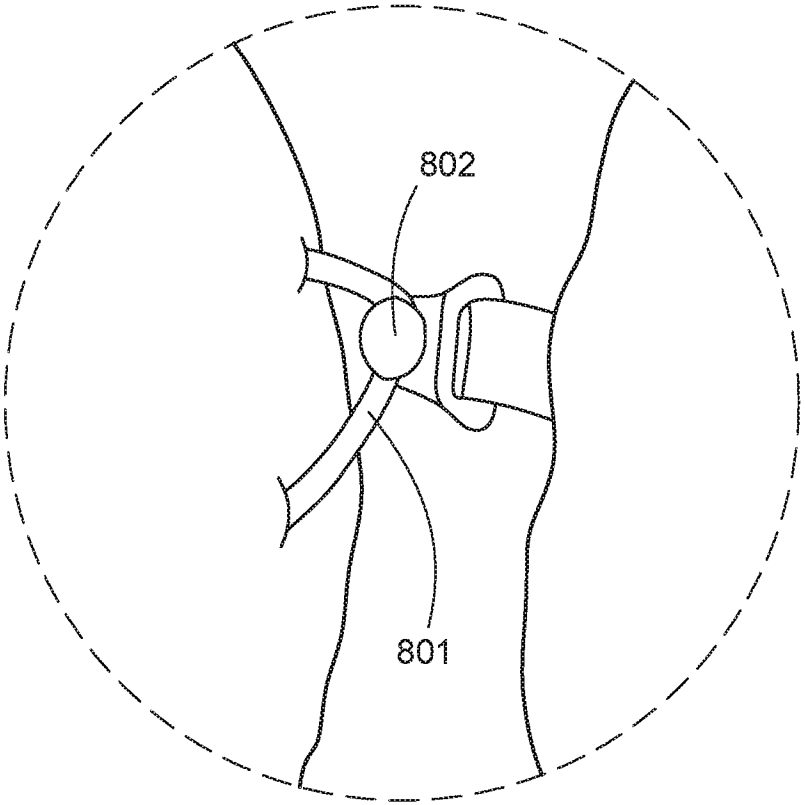
FIG. 11B illustrates schematically engaged cord loop and hook fastener elements.
Figure 11A:
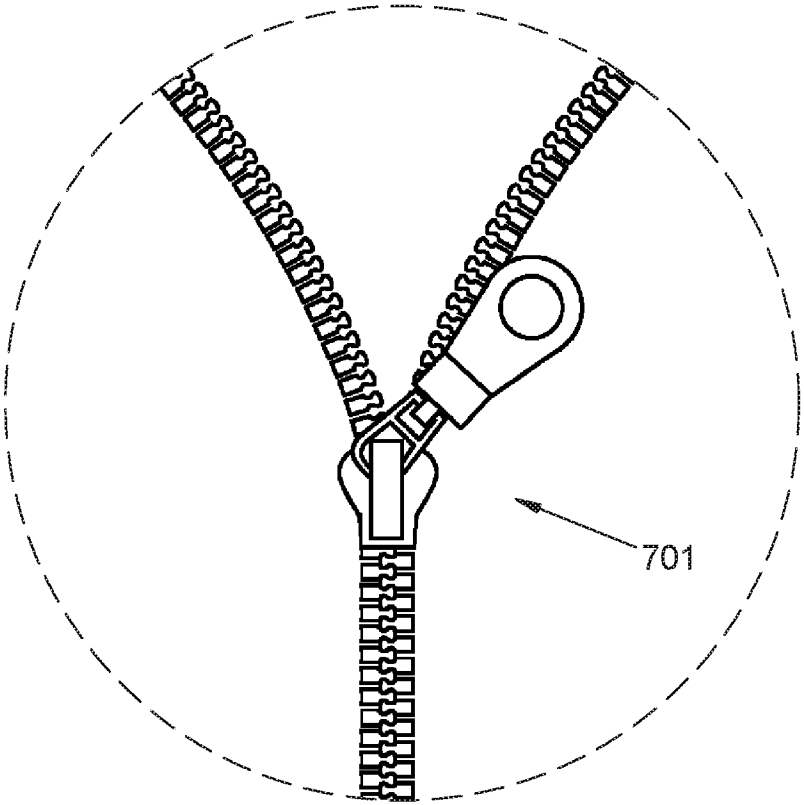
FIG. 11A illustrates schematically partly engaged half-zipper fastener elements.

The discrete bottom fastener elements 121*a*/121*b*/122*a*/122*b* are attached to the quilt along the quilt bottom edge 100*b*; the first pair comprises mating bottom fastener elements 121*a*/121*b*, and the second pair comprises mating bottom fastener elements 122*a*/122*b*. "Along the quilt bottom edge 100*b*" encompasses arrangements wherein the bottom fastener elements 121*a*/121*b*/122*a*/122*b* are attached at the quilt bottom edge 100*b* as well as arrangements wherein those fastener elements are displaced slightly from the quilt bottom edge 100*b* to leave a narrow strip of the quilt along the quilt bottom edge 100*b* to act as a baffle. "Discrete" fastener elements are to be contrasted with "continuous" fastener elements. A continuous fastener element attaches together different portions of a quilt or a sheet along a continuous line of attachment, leaving no significant gaps along that line of attachment. Examples of continuous fastener elements include but are not limited to, e.g., mating halves of a zipper 701 (FIG. 11A), mating strips of hook material and loop material of a hook-and-loop fastener (e.g., Velcro®), or strips of magnetic plastic (e.g., such as is used for refrigerator magnets). Discrete fastener elements attach together different portions of a quilt or sheet at only localized attachment points or areas along an attachment path, leaving gaps between those localized attachment points or areas. Examples of discrete fastener elements include but are not limited to, e.g., a cord loop 801 and a hook 802 to retain the cord loop (FIG. 11B), mating male and female snap elements, mating button and button hole, mating male and female buckle or clasp elements, mating circumscribed patches of hook material and loop material of a hook-and-loop material, or pairs of magnets. Note the difference between a cord loop 801 and a hook 802 (i.e., a single loop 801 of an elastic or inelastic cord material, and a hook 802 arranged to engage and retain the cord loop 801; as in FIG. 11B) versus a hook-and-loop material (e.g., Velcro®) that includes myriad tiny loops and tiny hooks arranged on strips or patches. In drawings showing all or portions of a quilt or sheet, fastener elements of a mating or corresponding pair are indicated by an "X" for one fastener element (e.g., a hook) and an "O" for the other fastener element (e.g., a cord loop). It is not intended that every "X" or that every "O" in a given drawing necessarily indicates the same type of fastener element, although that can sometimes be the case.

The two pairs of discrete bottom fastener elements 121*a*/121*b* and 122*a*/122*b* are arranged along the quilt bottom edge 100*b* so that only one discrete bottom fastener element 121*b* of the first pair is positioned between the discrete bottom fastener elements 122*a*/122*b* of the second pair, and only one discrete bottom fastener element 122*b* of the second pair is positioned between the discrete bottom fastener elements 121*a*/121*b* of the first pair. The bottom fastener elements 121*a*/121*b*/122*a*/122*b* thus divide the quilt bottom edge 100*b* into a first quilt bottom edge lateral segment 100*b*-1, a quilt bottom edge central segment 100*b*-2, and a second quilt bottom edge lateral segment 100*b*-3. The first quilt bottom edge lateral segment 100*b*-1 lies between the first pair of bottom fastener elements 121*a*/121*b* but not between the second pair of bottom fastener elements 122*a*/122*b* (thus between bottom fastener elements 121*a* and 122*b*); the second quilt bottom edge lateral segment 100*b*-3 lies between the second pair of bottom fastener elements 122*a*/122*b* but not between the first pair of bottom fastener elements 121*a*/121*b* (thus between bottom fastener elements 121*b* and 122*a*); the quilt bottom edge central segment 100*b*-2 lies between both pairs of bottom fastener elements 121*a*/121*b* and 122*a*/122*b* (thus between bottom fastener elements 121*b* and 122*b*). In some examples, the bottom fastener element 121*a* is positioned where the first quilt lateral edge 100*c* meets the quilt bottom edge 100*b* (e.g., at one bottom corner of a rectangular or trapezoidal quilt 100), and the bottom fastener element 122*a* is positioned where the second quilt lateral edge 100*d* meets the quilt bottom edge 100*b* (e.g., at the other bottom corner of a rectangular or trapezoidal quilt 100). In such examples, the quilt bottom edge segments 100*b*-1, 100*b*-2, and 100*b*-3 encompass the entire quilt bottom edge 100*b*.

Figure 2A:
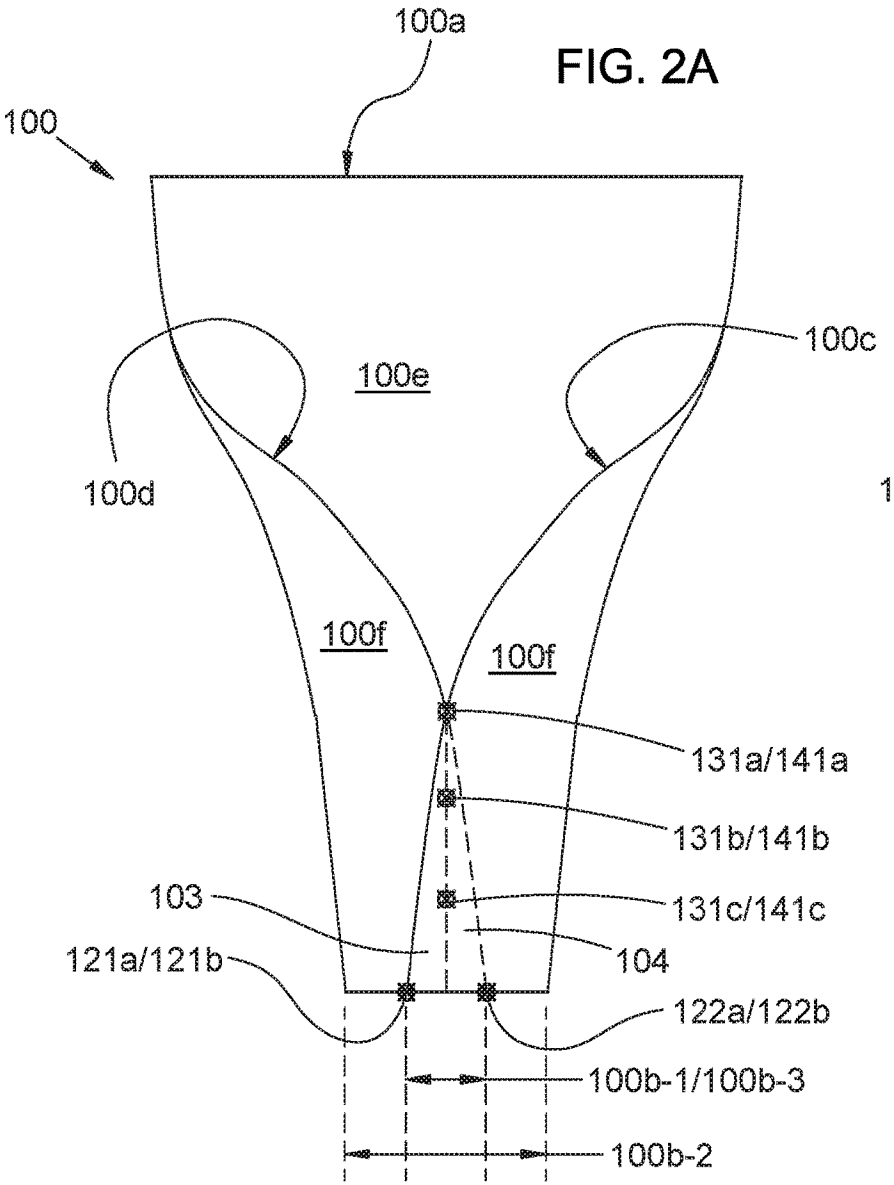
FIGS. 2A and 2B are schematic inner and bottom views, respectively, of the example quilt of FIGS. 1A/1B in an overlapping footbox-wrapped arrangement.
Figure 2B:
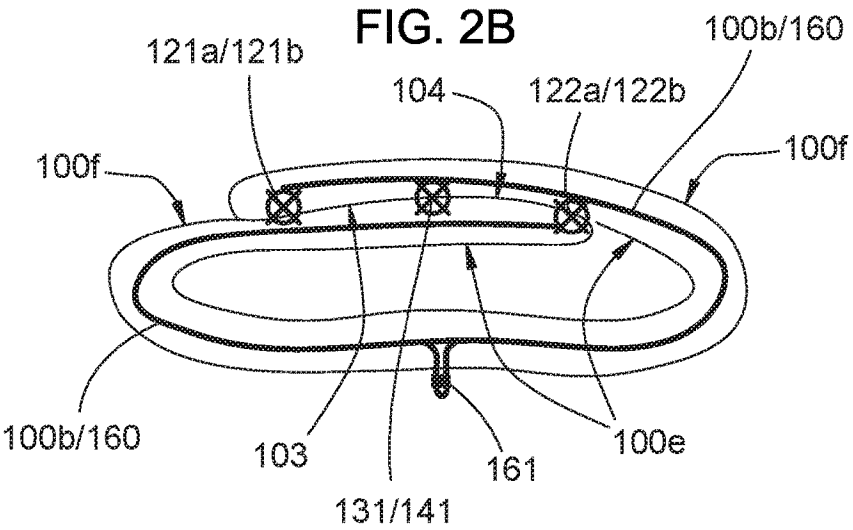

The footward portion of the quilt 100 can be wrapped or folded into an overlapping footbox-wrapped arrangement (e.g., as in FIGS. 2A/2B/2C; stitching omitted to avoid cluttering the drawings). In that arrangement, the quilt bottom edge lateral segments 100*b*-1 and 100*b*-3 overlap each other. Also in that arrangement, the mating discrete bottom fastener elements 121*a*/121*b* are positioned opposite each other, and the mating discrete bottom fastener elements 122*a*/122*b* are positioned opposite each other. Engagement of the bottom fastener elements 121*a*/121*b* with each other and engagement of the bottom fastener elements 122*a*/122*b* with each other retain at least the quilt bottom edge 100*b* in the overlapping footbox-wrapped arrangement with the first and second quilt bottom edge lateral segments 100*b*-1 and 100*b*-3 overlapping each other (may be referred to herein as a spiral or corkscrew arrangement of the quilt bottom edge 100*b;* seen most clearly in FIG. 2B).

The inner set of one or more quilt fastener elements 131 is attached to the quilt inner surface 100*e* along at least a portion of a linear or curved inner quilt attachment path 130. The inner quilt attachment path 130 extends from the first quilt lateral edge 100*c* to the first quilt bottom edge lateral segment 100*b*-1 and defines on the quilt inner surface 100*e* an inner quilt-overlap areal segment 103 bounded by the inner quilt attachment path 130, the quilt bottom edge 100*b,* and the first quilt lateral edge 100*c* (FIG. 1B). The outer set of one or more quilt fastener elements 141 is attached to the quilt outer surface 100*f* along at least a portion of a linear or curved outer quilt attachment path 140 that extends from the second quilt lateral edge 100*d* to the second quilt bottom edge lateral segment 100*b*-3 and defines on the quilt outer surface 100*f* an outer quilt-overlap areal segment 104 bounded by the outer quilt attachment path 140, the quilt bottom edge 100*b,* and the second quilt lateral edge 100*d* (FIG. 1A). Note that portions of the attachment paths 130 and 140 that extend to edges of the quilt 100 can in some examples be only virtual extensions of the attachment path defined by the corresponding fastener elements. In other examples a fastener element can be positioned at an edge of the quilt 100. In some examples wherein the quilt 100 is quilted, the attachments paths 130 and 140 can optionally lie along seams of the quilted pattern. In some examples the inner and outer quilt attachment paths 130/140 are substantially linear; in some examples the inner and outer quilt-overlap areal segments 103/104 are substantially triangular. When the quilt 100 is wrapped or folded into the overlapping footbox-wrapped arrangement, the outer quilt-overlap areal segment 104 faces a portion of the quilt inner surface 100*e,* and the inner quilt-overlap areal segment 103 faces a portion of the quilt outer surface 100*f* (shown in FIG. 2A although those areal segments would not be visible; most clearly seen in FIG. 2B). In that arrangement, each quilt fastener element 131 of the inner set is substantially aligned with a corresponding, mating quilt fastener element 141 of the outer set. Engaging the corresponding mating quilt fastener elements 131/141 of the inner and outer sets with each other retains at least a footward portion of the quilt 100 in the overlapping footbox-wrapped arrangement (locations of the engaged quilt fastener elements 131/141 indicated in FIGS. 2A/2B although they would not be visible).

Figure 2C:
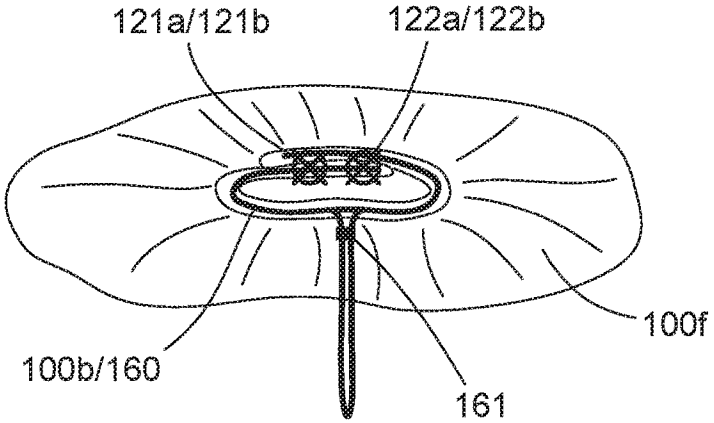
FIG. 2C is a schematic bottom view of the example quilt of FIGS. 2A/2B with the bottom edge gathered by the draw cord to form a closed, wrapped footbox of the sleeping bag.

The draw cord 160 is engaged with the quilt bottom edge 100*b;* in some examples the draw cord 160 extends substantially entirely across the quilt bottom edge 100*b.* The draw cord 160 can be of any suitable or conventional type or arrangement. With the quilt 100 retained in the overlapping footbox-wrapped arrangement by (i) engagement of the bottom fastener elements 121*a*/121*b* with each other, (ii) engagement of the bottom fastener elements 122*a*/122*b* with each other, and (iii) engagement of the corresponding quilt fastener elements 131/141 of the inner and outer sets with each other, then pulling the draw cord 160 gathers the quilt bottom edge 100*b* to form a closed footbox of the sleeping bag (FIG. 2C). To secure the closed footbox of the sleeping bag, one or both of the draw cord 160 or the quilt bottom edge 100*b* can in some examples be structurally arranged so as to secure the draw cord 160 with the quilt bottom edge 100*b* gathered. In some of those examples, the draw cord 160 can include a retaining member 161 that secures the draw cord 160 with the quilt bottom edge 100*b* gathered. An example of such a retaining member 161 is a conventional cord lock of any suitable type that can slide along the draw cord 160 and then be locked into place at a chosen position along the draw cord 160.

Figure 3B:
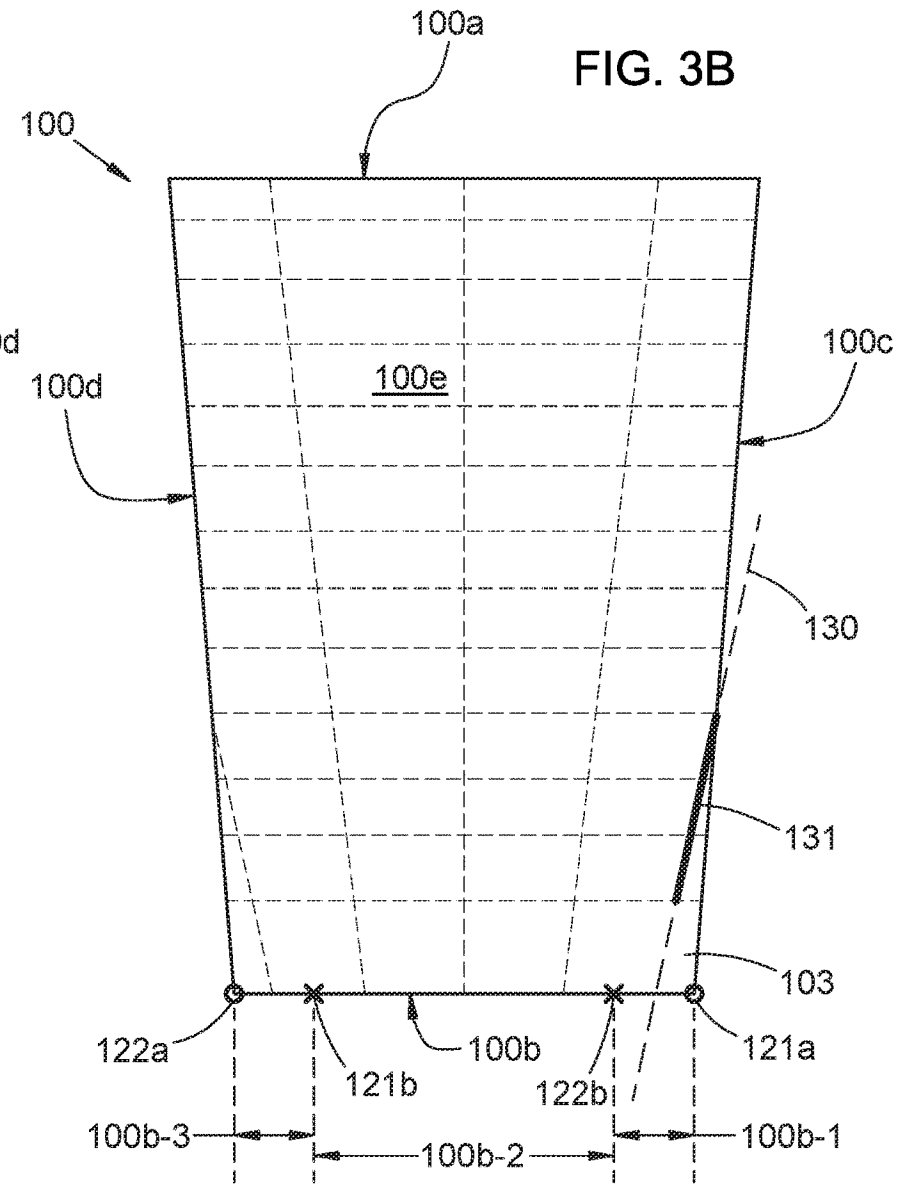
FIGS. 3A and 3B are schematic outer and inner views, respectively, of another example quilt of an inventive sleeping bag in a flattened arrangement.
Figure 3A:
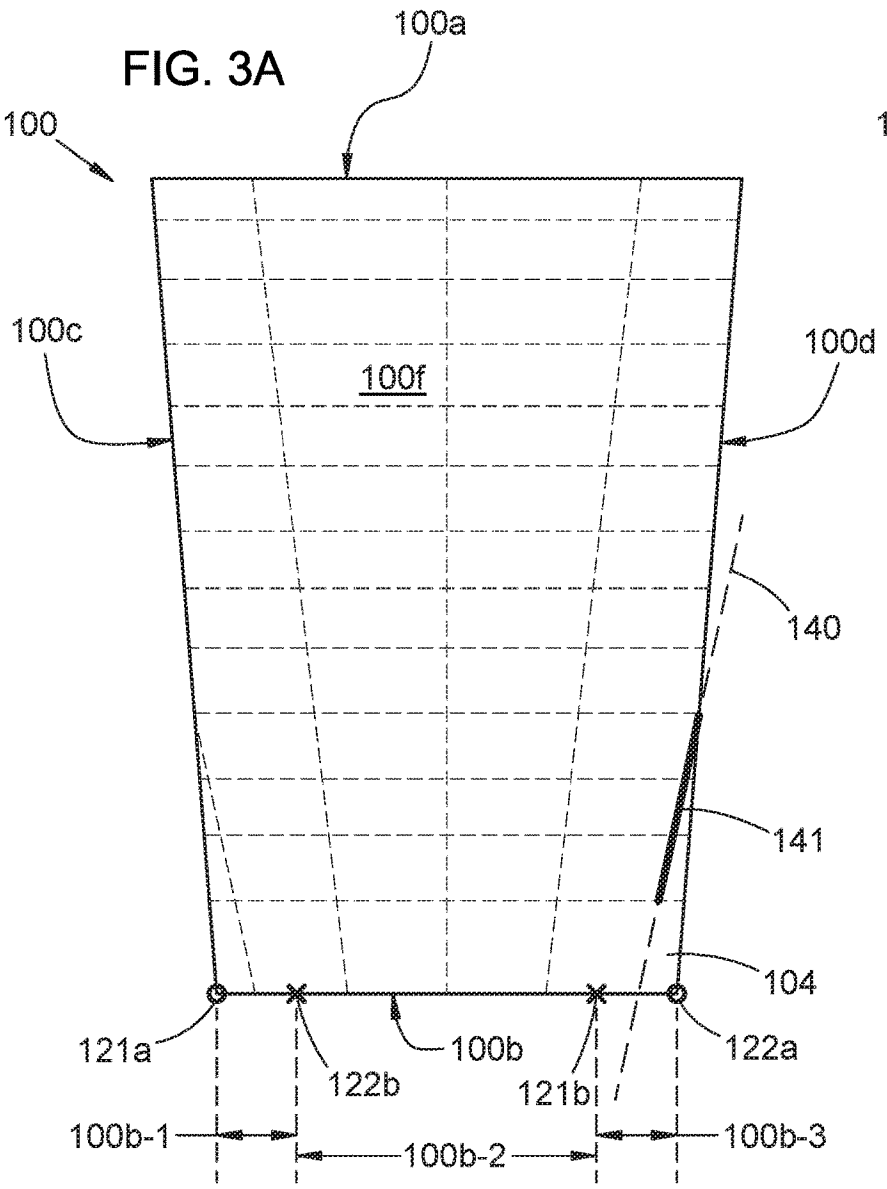

In some examples, the inner set of quilt fastener elements 131 comprises a continuous quilt fastener element 131 attached to the quilt inner surface 100*e* along at least a portion of the inner quilt attachment path 103 (FIG. 3B). Similarly, in those examples the outer set of quilt fastener elements 141 comprises a continuous quilt fastener element 141 attached to the quilt outer surface 100*f* along at least a portion of the outer quilt attachment path 140 (FIG. 3A). The continuous fastener elements 131/141 can in some examples extend to the respective quilt side edges 100*c*/100*d,* or can in other examples extend only partly toward those edges. The continuous fastener elements 131/141 typically do not extend all the way to the quilt bottom edge 100*b;* instead their respective footward ends are displaced in a headward direction from the quilt bottom edge 100*b*. The continuous fastener elements 131/141 can be of any suitable type or arrangement, including those described above (e.g., mating zipper halves, mating hook-and-loop material strips, or strips of magnetic plastic).

In some examples, the inner set of quilt fastener elements 131 comprises an inner set of multiple discrete quilt fastener elements 131*a*/131*b*/ . . . attached to the quilt inner surface 100*e* along at least a portion of the inner quilt attachment path 130 (FIG. 1B). Similarly, in those examples the outer set of one or more quilt fastener elements 141 comprises an outer set of multiple discrete quilt fastener elements 141*a*/141*b*/ . . . attached to the quilt outer surface 100*f* along at least a portion of the outer quilt attachment path 140. The inner and outer sets of quilt fastener elements 131/141 and the inner and outer quilt attachment paths 130/140 are structurally arranged so that, with the quilt 100 wrapped in the overlapping footbox-wrapped arrangement, each discrete quilt fastener element 131*a*/131*b*/ . . . of the inner set is substantially aligned with a corresponding, mating, discrete quilt fastener element 141*a*/141*b*/ . . . of the outer set. In some examples the topmost discrete quilt fastener element 131*a* of the inner set is positioned on the first quilt lateral edge 130, and the topmost discrete quilt fastener element 141*a* of the outer set is positioned on the second quilt lateral edge 100*d*. In other examples the topmost quilt fastener elements 131*a*/141*a* are displaced from the respective quilt lateral edges 130/140. The bottommost discrete quilt fastener elements of the inner and outer sets (quilt fastener elements 131*c*/141*c* in the example in the drawings) typically are displaced in a headward direction from the quilt bottom edge 100*b*. The discrete quilt fastener elements 131/141 can be of any suitable type or arrangement, including those described above (e.g., a cord loop and a hook, mating male and female snap elements, mating button and button hole, mating male and female buckle or clasp elements, mating circumscribed patches of hook material and loop material of a hook-and-loop material, or pairs of magnets).

In many examples, all of the discrete quilt fastener elements 131 of the inner set are of one type (e.g., all cord loops, or all male snap elements), and all of the discrete fastener elements 141 of the outer set are of the one corresponding other type that mates with or corresponds to that of the inner set (e.g., all hooks if the inner set is all cord loops, or all female snap elements if the inner set is all male snap elements). In addition, in many of those examples the fastener element types chosen for the quilt fastener elements 131/141 are the same as those chosen for the bottom fastener elements 121*a*/121*b*/122*a*/122*b*, although that need not be the case. Such arrangements can be advantageous, e.g., by simplifying the manufacturing processes employed to produce the inventive sleeping bag, however, those conditions are not required. The only requirement is that, for each pair of corresponding inner and outer quilt fastener elements (131*a*/141*a*, 131*b*/141*b*, and so forth), the two fastener elements are of mating or corresponding types that can engage and retain each other. It is therefore possible to "mix-and-match" inner quilt fastener elements 131*a*/131*b*/ . . . of any desired mixture and sequence of fastener element types along the inner attachment path 130 with outer quilt fastener elements 141*a*/141*b*/ . . . of a mixture and sequence of mating or corresponding fastener element types. Such mixed-type sets of inner and outer quilt fastener elements 131/141 can be advantageous, e.g., by guiding a user toward engaging the correct pairs of inner and outer quilt fastener elements with each other when deploying the sleeping bag. Such mixed-type sets of inner and outer quilt fastener elements 131/141 shall fall within the scope of the present disclosure or appended claims.

The inventive closure arrangement described above for the footward portion of the quilt 100 is used to form a closed footbox of the sleeping bag formed by the quilt 100. That inventive closure arrangement can be particularly advantageous when multiple discrete fastener elements are employed instead of continuous fastener elements. A common problem that arises with the use of discrete fasteners in a sleeping bag closure is that the sleeping bag portions joined by the discrete fastener elements can still separate from each other along the gaps between adjacent engaged pairs of fastener elements. Movement of an occupant of the sleeping bag tends to cause intermittent separations along those gaps, and those separations allow heat to escape from the sleeping bag, degrading its performance. The inventive arrangement, including the overlapped arrangement of the bottom quilt edge lateral segments 100*b*-1 and 100*b*-3 (i.e., the so-called spiral or corkscrew arrangement; seen most clearly in FIGS. 2B/2C), the inner and outer sets of quilt fastener elements 131/141 arranged along attachment paths 130/140 that slant inward and downward from the quilt lateral edges 100*c*/100*d*, the quilt-overlap areal segments 103/104 facing the respective quilt outer/inner surfaces 100*f*/100*e*, and the draw cord 160 along the quilt bottom edge 100*b*, all act together to form the closed footbox of the sleeping bag in a way that resists, reduces, and in some instances eliminates separation of the joined portions of the quilt 100 that form the footbox of the sleeping bag, even when the occupant moves around in it.

Weight is an important constraint in designing outdoor gear, particularly if that gear is to be carried by person traveling on foot over a significant distance (e.g., during a backpacking outing). Lightweight materials and specialized construction techniques have been developed over the years to produce ever lighter gear items such as tents and sleeping bags. As weight limits are pressed lower and lower, finding ways to cut further weight becomes correspondingly more difficult.

In a so-called ultralight sleeping bag or quilt, the zippers account for a significant percentage of the overall weight, in some cases about 10% to about 20% or even more. A zipper-less sleeping bag arrangement could potentially eliminate that weight, thereby enabling further overall weight reduction of the sleeping bag, or replacement of the zipper weight with, e.g., more or denser fill for enhancing the thermal performance of the sleeping bag, or heavier cover material for improved durability. Unfortunately, as noted above, simply replacing the zippers (i.e., a continuous fastener) with a lighter set of discrete fasteners in conventional sleeping bag closure arrangement can allow the connected portions of the sleeping bag to separate from one another between the discrete fasteners as the occupant of the sleeping bag moves around. Such separation allows heat to escape from the sleeping bag and can seriously degrade its performance in cold conditions. It would be desirable to provide a zipper-less sleeping bag, comprising a quilt and various discrete fasteners, that is structurally arranged so that portions of the quilt that are joined by the discrete fasteners do not separate, or separate less, or separate less readily, when the occupant of the sleeping bags moves around. The inventive sleeping bag footbox closure arrangement described above provides that new and useful functionality.

The inventive sleeping bag footbox closure arrangement described above (referred to herein as the overlapping footbox-wrapped arrangement) can be employed when the sleeping bag is used without its footward portion being attached to another article (e.g., such as a sheet of sleeping pad). In some instances a user might want to expand the footbox of the sleeping bag and attach it to a sleeping pad, typically by attaching it to a sheet on the sleeping pad. The inventive sleeping bag described above can be further adapted to provide that additional new and useful functionality.

Figure 4B:
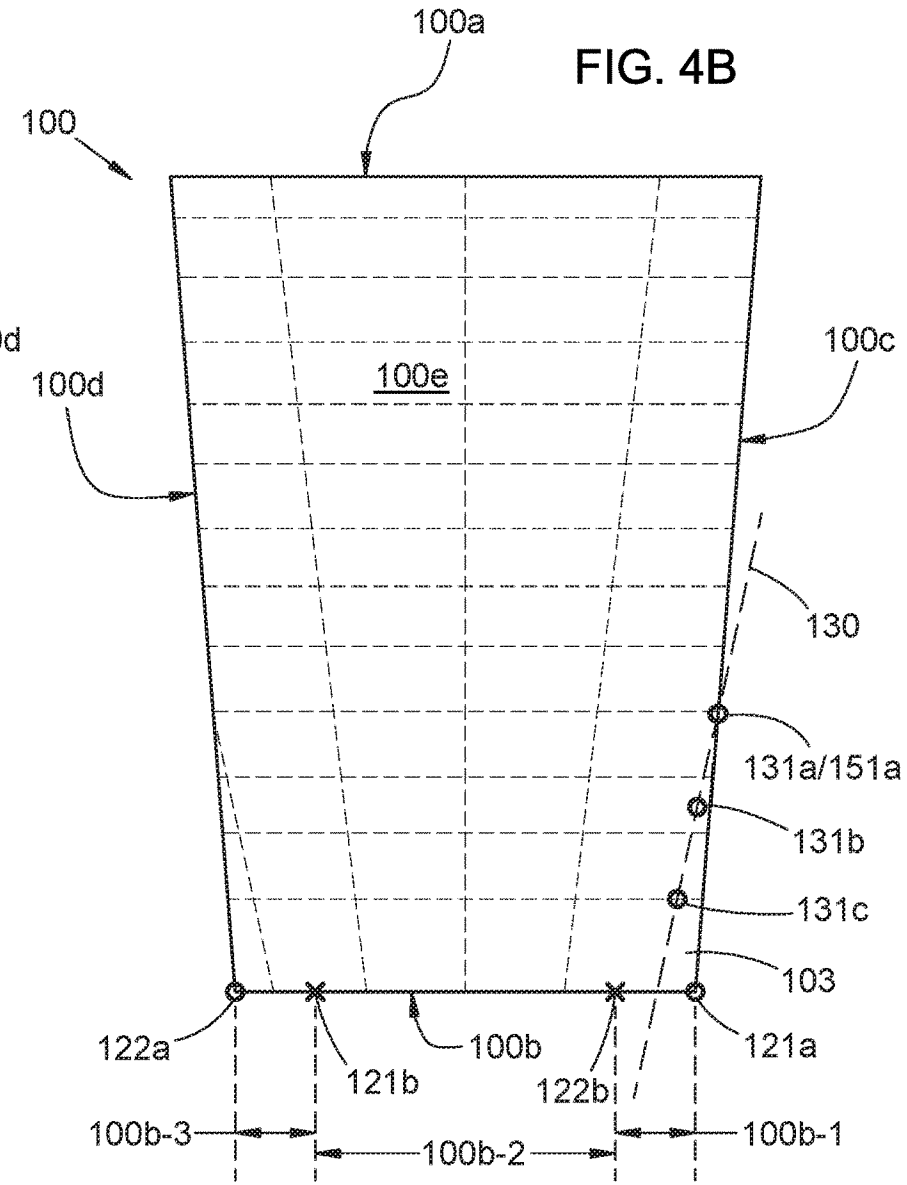
FIGS. 4A and 4B are schematic outer and inner views, respectively, of another example quilt of an inventive sleeping bag in a flattened arrangement.
Figure 4A:
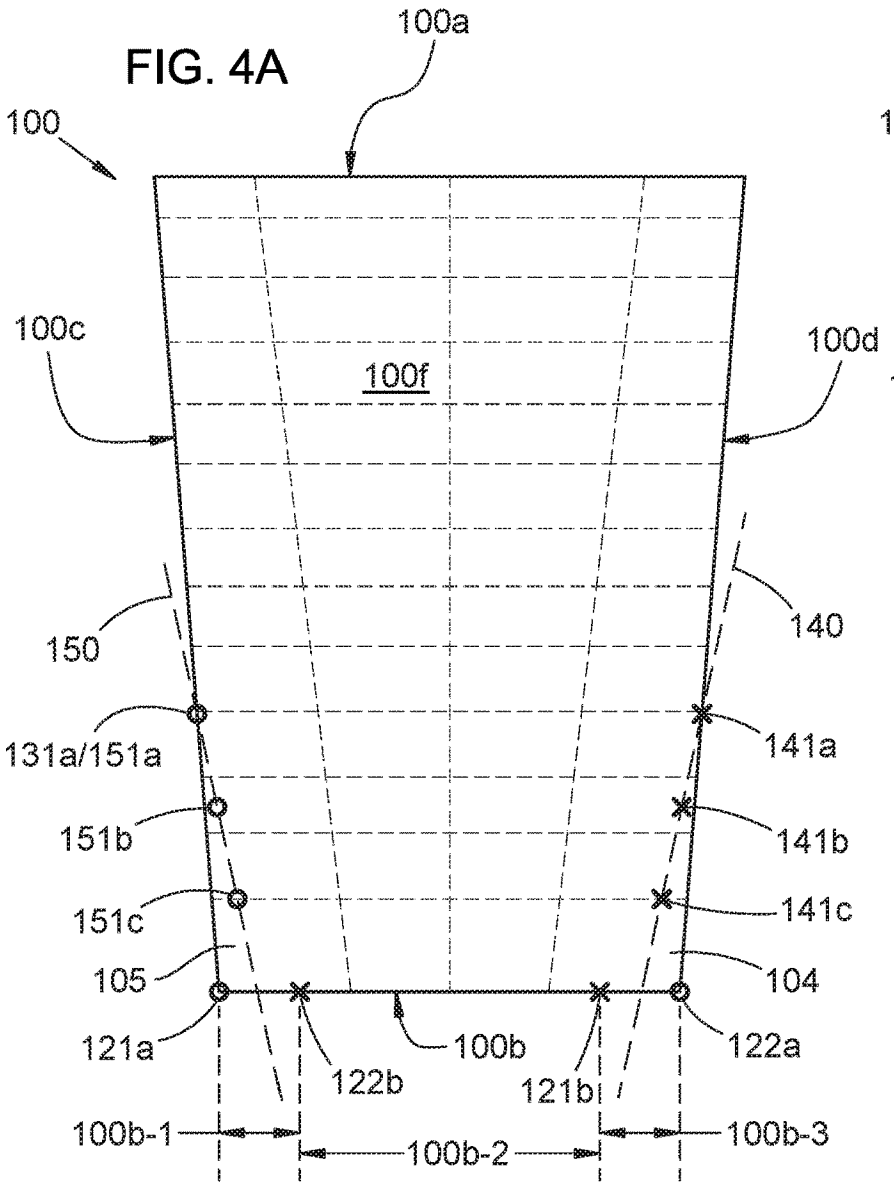

An additional set of one or more quilt fastener elements 151 can be attached to the quilt outer surface 100*f* along at least a portion of a linear or curved additional quilt attachment path 150 (FIGS. 4A/4B). The additional attachment path 150 extends from the first quilt lateral edge 100*c* to the first quilt bottom edge lateral segment 100*b*-1 and defines on the quilt outer surface 100*f* an additional quilt-overlap areal segment 105 bounded by the additional outer quilt attachment path 150, the quilt bottom edge 100*b*, and the first quilt lateral edge 100*c*. The additional quilt attachment path 150 typically, but not necessarily, follows on the quilt outer surface 100*f* the same path that the inner quilt attachment path 130 follows on the quilt inner surface 100*e*; in that case the additional quilt-overlap areal segment 105 reproduces on the quilt outer surface 100*f* the size, shape, and position of the inner quilt-overlap areal segment 103 on the quilt inner surface 100*e*. A sheet 200 (FIGS. 5A/5B/5C) is structurally arranged in any suitable way to be secured to a sleeping pad 299 of any suitable type, size, and shape, e.g., by being arranged as a fitted sheet, or by including straps or ties for wrapping around the sleeping pad 299, or by enclosing the entire sleeping pad 299 in a manner similar to a pillowcase enclosing a pillow. The sheet 200 includes on its outer surface a first set of one or more sheet fastener elements 241 that are structurally arranged along a corresponding linear or curved first sheet attachment path 240, and a second set of one or more sheet fastener elements 251 that are structurally arranged along corresponding linear or curved second sheet attachment path 250. The first and second attachment paths 240/250 are structurally arranged generally longitudinally along at least corresponding footward portions of respective first and second lateral edges of the sheet 200. In some examples the first and second sheet attachment paths 240/250 are positioned on respective first and second sheet lateral edges; in other examples the first and second sheet attachment paths 240/250 are displaced medially from the respective first and second sheet lateral edges.

Figure 5B:
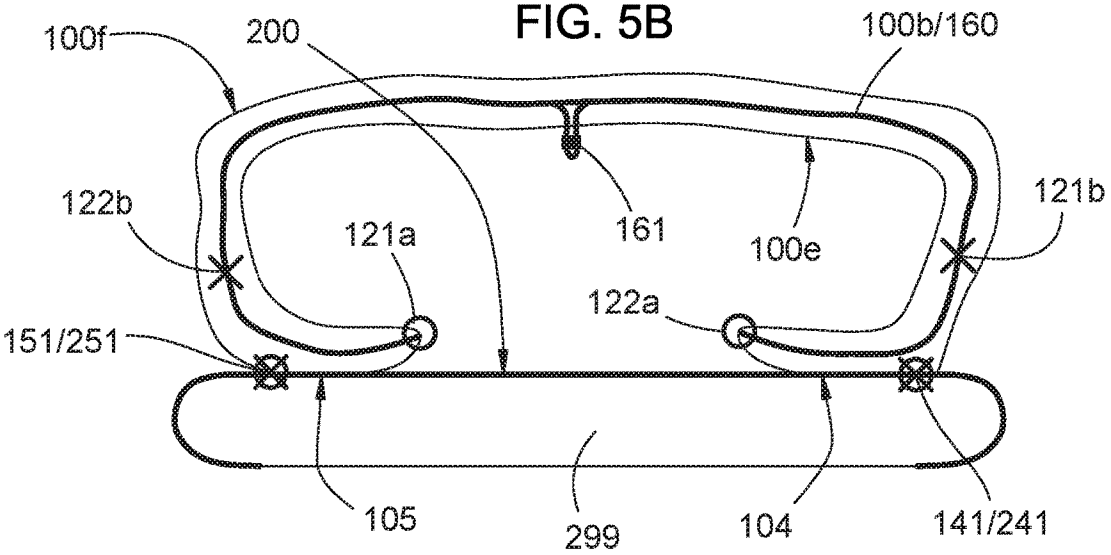
FIG. 5B is a schematic bottom view of the example quilt of FIGS. 4A/4B attached in a footbox-expanded arrangement to the example sheet of FIG. 5A.
Figure 5C:
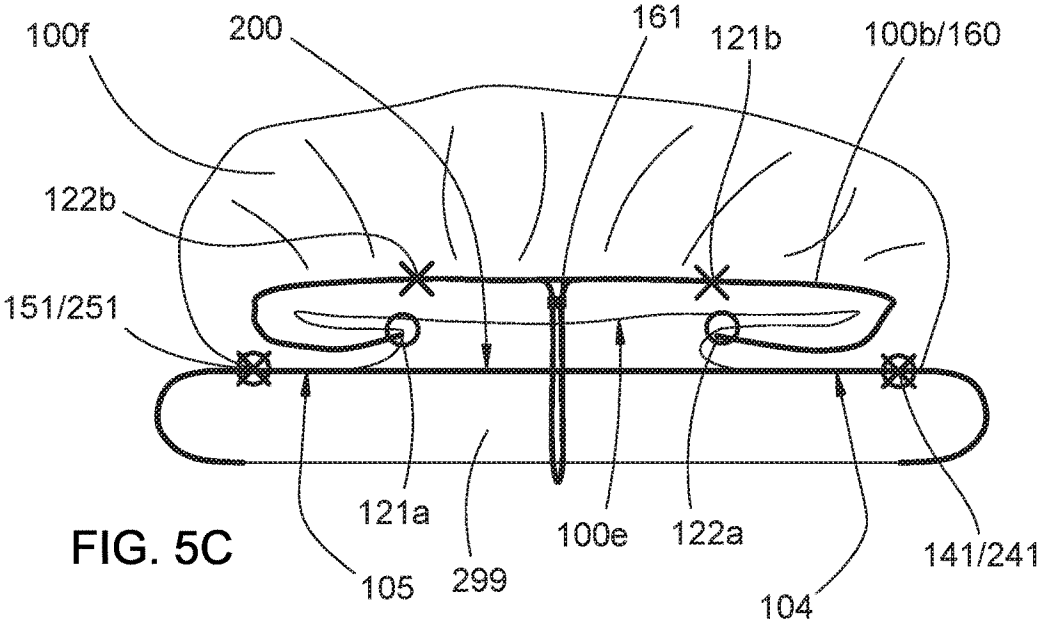
FIG. 5C is a schematic bottom view of the example quilt of FIG. 5B with the bottom edge gathered by the draw cord to form a closed, expanded footbox of the sleeping bag.
Figure 5A:
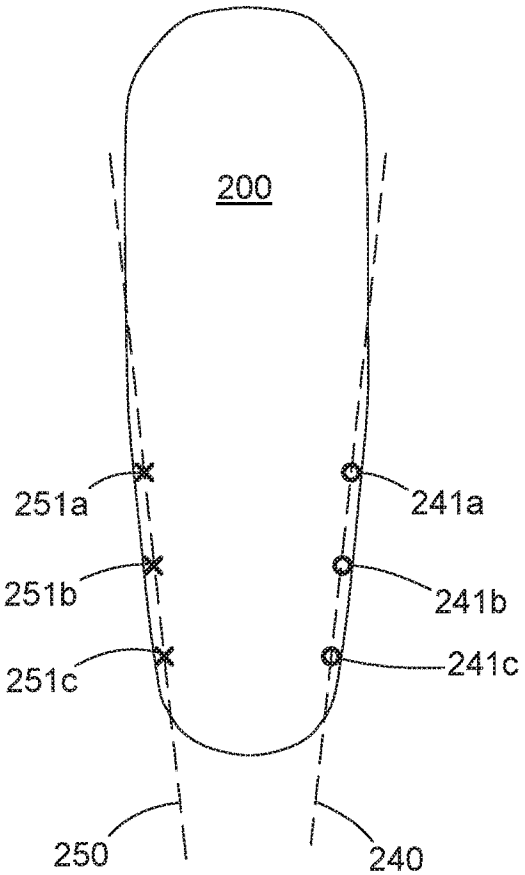
FIG. 5A is a schematic outer view of an example sheet of an inventive sleeping bag secured to a sleeping pad.

To use the quilt 100 in a footbox-expanded arrangement, the bottom fastener elements 121*a*/122*b* are disengaged from each other, the bottom fastener elements 122*a*/122*b* are disengaged from each other, and the inner and outer sets of quilt fastener elements 131/141 are disengaged from each other. With all of those fastener elements disengaged, the quilt 100 can be unwrapped or unfolded into a footbox-expanded arrangement and positioned over the sheet 200 with the quilt inner surface 100*e* facing the sheet outer surface (FIGS. 5B/5C). The quilt-overlap areal segments 104 and 105 on the quilt outer surface 100*f* are tucked or folded under to face corresponding portions of the sheet outer surface (FIGS. 5B/5C). Thus positioned and arranged, each quilt fastener element 141 of the outer set is substantially aligned with a corresponding, mating sheet fastener element 241 of the first set, and each quilt fastener element 151 of the additional set is substantially aligned with a corresponding, mating sheet fastener element 251 of the second set. By engaging the corresponding mating quilt and sheet fastener elements 141/241 of the respective outer and first sets with each other, and engaging the corresponding mating quilt and sheet fastener elements 151/251 of the respective additional and second sets with each other, at least a footward portion of the quilt 100 is retained and secured to the sheet 200 in the footbox-expanded arrangement (FIGS. 5B/5C). In cooler conditions when a closed footbox might be desired, the draw cord 160 can be pulled to gather the bottom edge 100*b* and form a closed, expanded footbox of the sleeping bag (FIG. 5C). Alternatively, in warmer conditions when an open footbox might be desired, the quilt bottom edge 100*b* can be left ungathered so that the footbox is left open in its footbox-expanded arrangement (FIG. 5B). To convert back to the closed overlapping footbox-wrapped arrangement, the quilt fastener elements 141 and the sheet fastener elements 241 are disengaged from each other and the quilt fastener elements 151 and the sheet fastener elements 251 are disengaged from each other. The quilt 100 can then be returned to the overlapping footbox-wrapped arrangement as described above.

The type(s) and arrangement of the sheet fastener elements 241 are chosen to mate with or correspond to the type(s) and arrangement of the outer quilt fastener elements 141, so that those fasteners can be engaged with each other (e.g., a cord loop corresponds to a hook and vice versa, or a button corresponds to a buttonhole and vice versa, and so on for other fastener element types). The type(s) and arrangement of the sheet fastener elements 251 are chosen to mate with or correspond to the type(s) and arrangement of the additional quilt fastener elements 151, so that those fasteners can be engaged with each other. The type(s) and arrangement of the additional quilt fastener elements 151 can in principle be arbitrarily chosen from among any of the continuous or discrete fastener element types, including any one or more of those described above. Alternatively, the sheet fastener elements 251 can be arbitrarily chosen, and then additional quilt fastener elements 151 can be chosen to mate or correspond. More typically, however, the additional quilt fastener element(s) 151 are chosen to have the same type(s) and arrangement as either the inner quilt fastener element(s) 131 or the outer quilt fastener element(s) 141.

If the outer and additional quilt fastener elements 141/151 are of the same types(s) and arrangement as each other, then the sheet fastener elements 241/251 must also be of the same type(s) and arrangement as each other and correspond to the quilt fastener elements 141/151. In one such example, the inner quilt fastener elements 131 are all cord loops, the outer and additional quilt fastener elements 141/151 are all hooks, and the first and second sheet fastener elements 241/251 are all cord loops. Such arrangements can be advantageous for simplifying manufacture of the sheet 200 and quilt 100.

If the inner and additional quilt fastener elements 131/151 are of the same types(s) and arrangement as each other, then the sheet fastener elements 241/251 will differ from each other with respect to fastener type(s) and arrangement, while mating with or corresponding to the respective quilt fastener elements 141/151. In one such example, the inner and additional quilt fastener elements 131/151 are all cord loops, the outer quilt fastener elements 141 are all hooks, the first sheet fastener elements 241 are all cord loops, and the second sheet fastener elements 251 are all hooks). Such an arrangement can be advantageous for guiding assembly of the quilt 100 with the sheet 200 (because they can only go together one way). Also in some examples of such an arrangement that employ discrete quilt fastener elements, the topmost inner quilt fastener element 131*a* can also be the topmost additional quilt fastener element 151*a* (FIGS. 4A/4B).

Figure 6B:
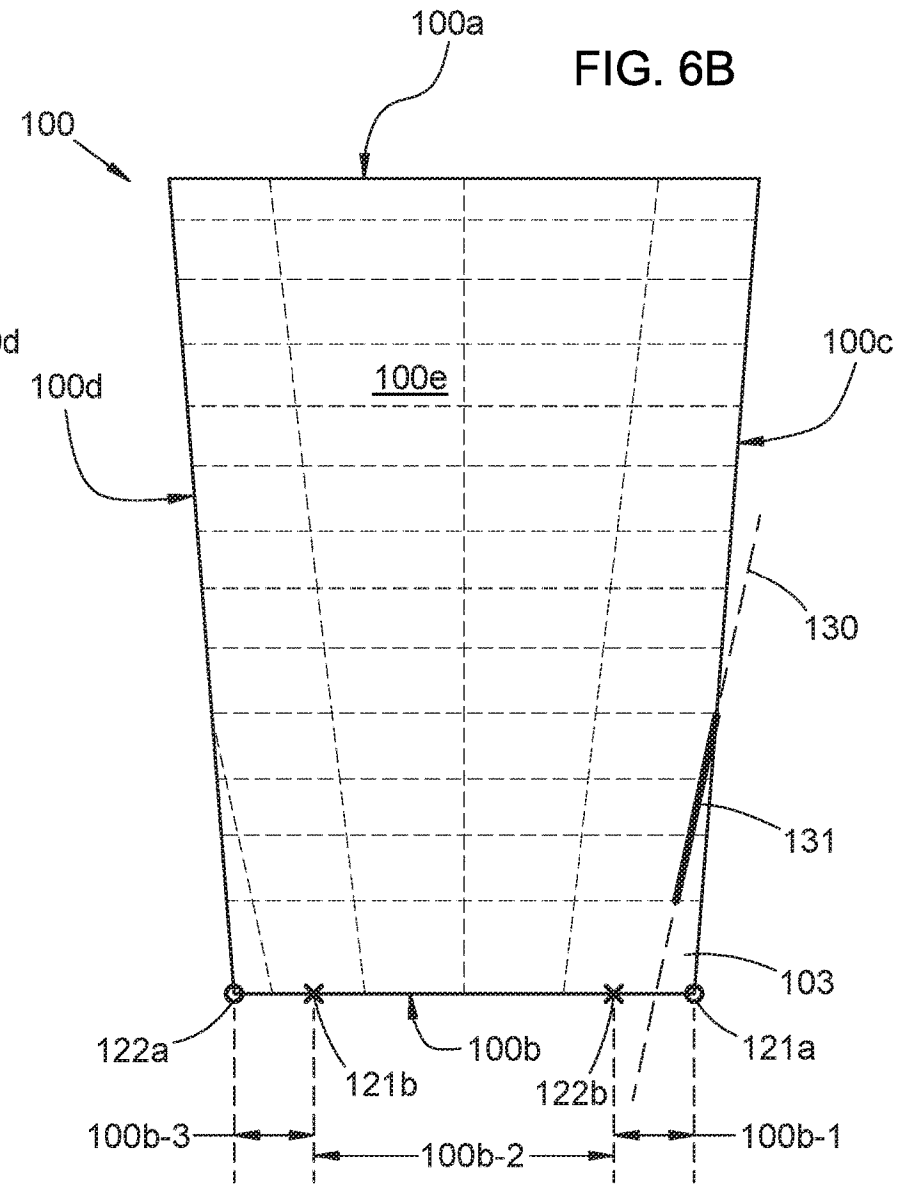
FIGS. 6A and 6B are schematic outer and inner views, respectively, of another example quilt of an inventive sleeping bag in a flattened arrangement.
Figure 6A:
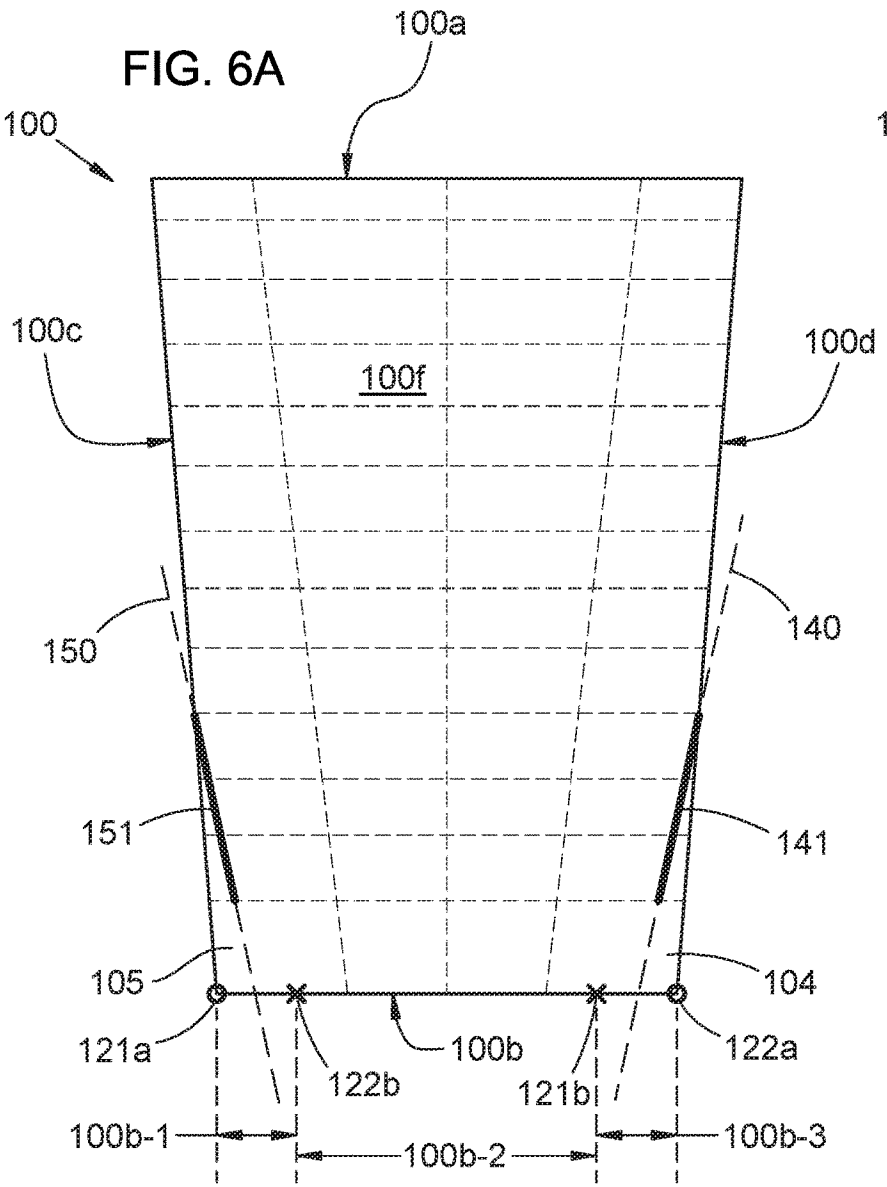

Any of the various continuous or discrete type(s) and arrangements described above for the inner/outer quilt fastener elements 131/141 can be employed for the additional quilt fastener elements 151 and the first/second sheet fastener elements 241/251, including, e.g., continuous fastener elements (FIGS. 6A/6B and 10B), discrete fastener elements (FIGS. 4A/4B and 5A), sets of only a single fastener element type, mixed-type sets of fastener elements, and so forth.

The arrangement of the additional quilt fastener elements 151 and the sheet fastener elements 241/251 provides the new and useful functionality that a quilt 100 usable as a sleeping bag can be readily converted between (i) an arrangement having a self-contained, closed footbox and (ii) an arrangement having an expanded footbox that is attached to a sheet 200 (and therefore usually also indirectly attached to a sleeping pad 299 on which the sheet 200 is deployed). The new and useful sheet-attached, expanded-footbox functionality is provided in the examples described above in combination with the inventive overlapping, footbox-wrapped arrangement of the closed footbox. However, the sheet-attached expanded-footbox arrangement can be implemented independently of the overlapping, footbox-wrapped arrangement, and can in some examples be employed with a conventional quilt usable as a sleeping bag in combination with an inventive sheet. A sheet thus usable to provide the sheet-attached expanded-footbox arrangement can be provided together with the quilt as a set, or can be provided separately from the quilt as an accessory or a retrofit.

Figure 7B:
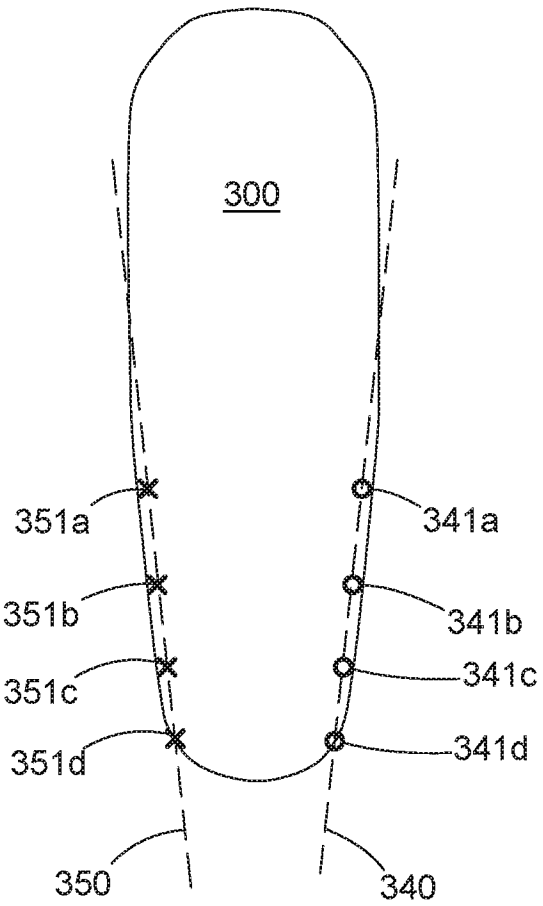
FIGS. 7A and 7B are schematic outer views of another example quilt and another example sheet of an inventive sleeping bag.
Figure 7A:
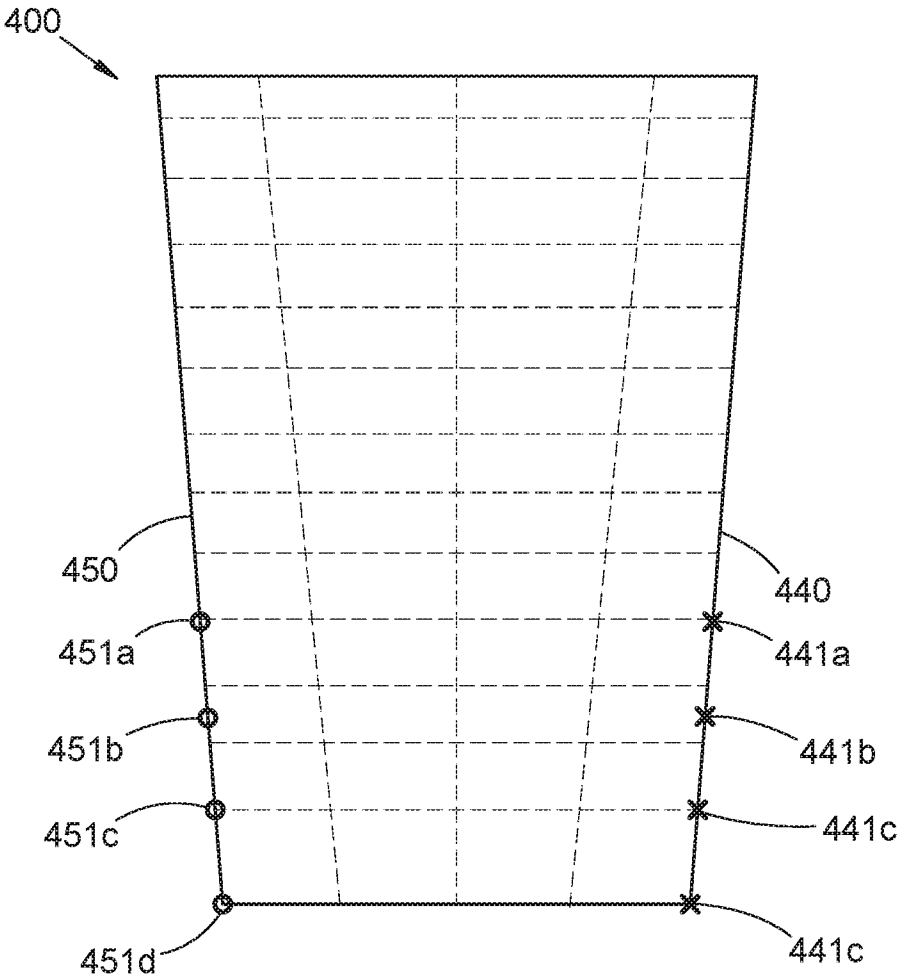

A sheet 300 adapted for use with a sleeping bag is illustrated in FIG. 7B. The sheet 300 is structurally arranged to be secured to a sleeping pad 399 of any suitable type, size, and shape in any suitable way, including those described above. A first set of one or more sheet fastener elements 341 is attached to an outer surface of the sheet 300; the sheet fastener elements 341 are structurally arranged along a linear or curved first sheet attachment path 340 on the sheet outer surface. A second set of one or more sheet fastener elements 351 is attached to the sheet outer surface; the sheet fastener elements are structurally arranged along a linear or curved second sheet attachment path 351 on the sheet outer surface. The first and second attachment paths 340/350 are structurally arranged generally longitudinally along at least corresponding footward portions of respective first and second lateral edges of the sheet 300. In some examples the first and second sheet attachment paths 340/350 can be positioned on respective first and second sheet lateral edges; in other examples the first and second sheet attachment paths 340/350 can be displaced medially from the respective first and second sheet lateral edges. The sheet attachment path 340 and the sheet fastener elements 341 are arranged so that the sheet fastener elements 341 and a corresponding first set of quilt fastener elements 441 (attached along an attachment path 440 on a quilt 400 usable as a sleeping bag; FIG. 7A) can engage each other. Similarly, the sheet attachment path 350 and the sheet fastener elements 351 are arranged so that the sheet fastener elements 351 and a corresponding second set of quilt fastener elements 451 (attached along a second quilt attachment path 450 on the quilt 400; FIG. 7A) can engage each other.

Figure 8A:
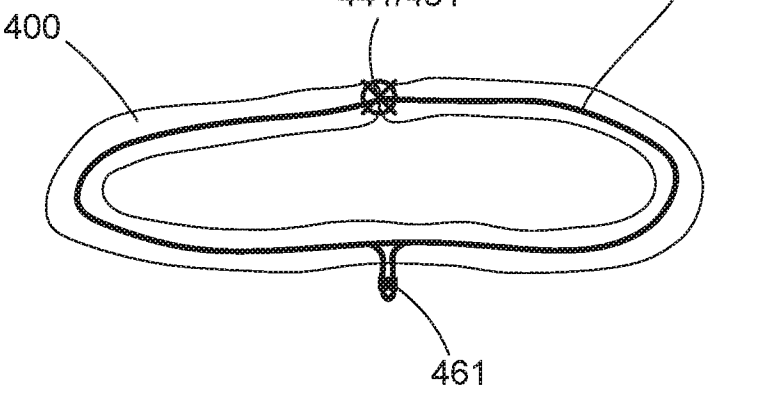
FIG. 8A is a schematic bottom view of the example quilt of FIG. 7A in an open footbox-wrapped arrangement.
Figure 8B:
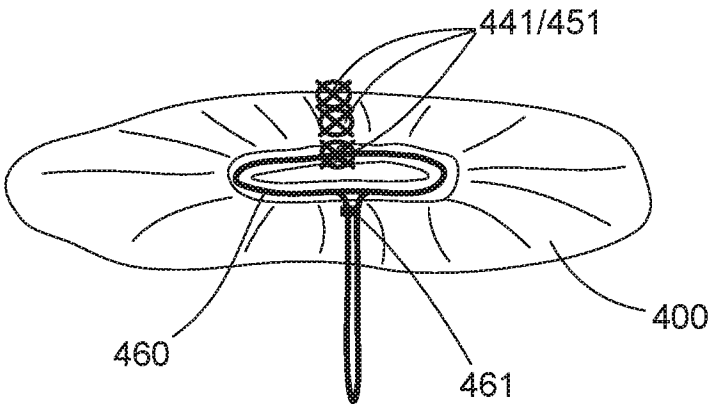
FIG. 8B is a schematic bottom view of the example quilt of FIG. 7A in a closed footbox-wrapped arrangement.
Figure 9A:
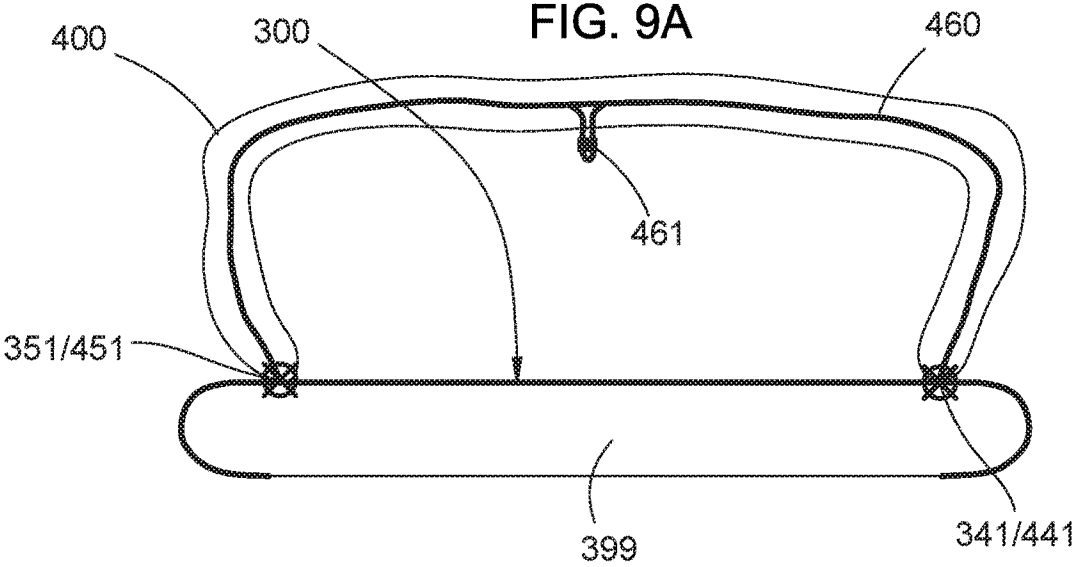
FIG. 9A is a schematic bottom view of the example quilt of FIG. 7A attached in an open footbox-expanded arrangement to the example sheet of FIG. 7B.

The quilt fastener elements 441/451 typically are arranged to engage each other and hold at least a footward portion of the quilt 400 in a wrapped, folded, or closed arrangement (optionally but not necessarily overlapping) when not being used in conjunction with the sheet 300 (as in FIG. 8A, with an open, expanded footbox, or as in FIG. 8B, with a closed footbox formed by pulling the draw cord 460). With the quilt 400 in an unwrapped arrangement with the first and second sets of quilt fastener elements 441/451 disengaged from each other, the quilt 300 can be positioned over the sheet 400 with a quilt inner surface facing the sheet outer surface (FIGS. 9A/9B). Each quilt fastener element 441 of the first set is then substantially aligned with a corresponding, mating sheet fastener element 341 of the first set, and each quilt fastener element 451 of the second set is substantially aligned with a corresponding, mating sheet fastener element 351 of the second set. Engaging the corresponding mating quilt and sheet fastener elements 341/441 with each other, and engaging the corresponding mating quilt and sheet fastener elements 351/451 with each other, retain at least a footward portion of the quilt 400 secured to the sheet 300 in a footbox-expanded arrangement (FIGS. 9A/9B; similar to that described above for the quilt 100 and sheet 200 and shown in FIGS. 5B/5C).

Figure 10B:
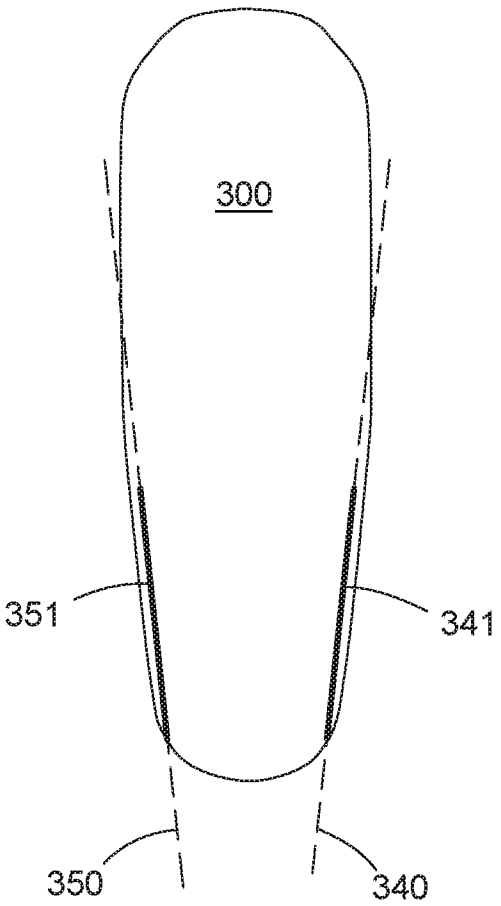
FIGS. 10A and 10B are schematic outer views of another example quilt and another example sheet of an inventive sleeping bag.
Figure 10A:
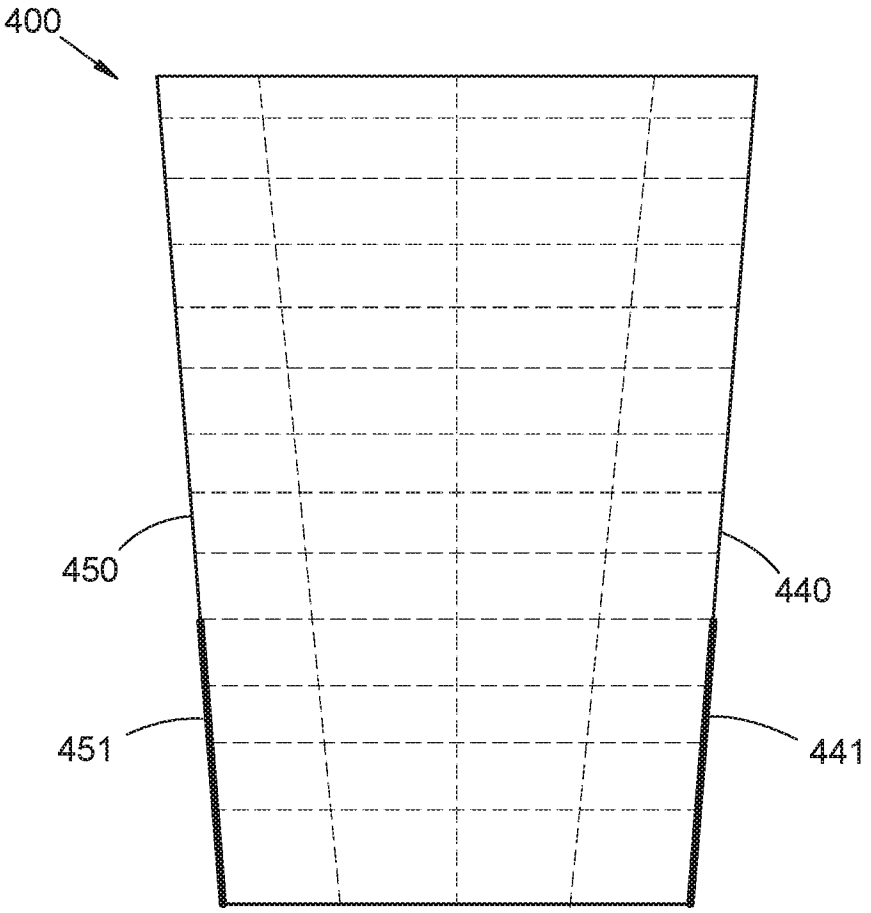

Any of the various continuous or discrete type(s) and arrangements described above for the inner/outer quilt fastener elements 131/141 can be employed for the first/second sheet fastener elements 341/351 and the first/second quilt fastener elements 441/451, including, e.g., continuous fastener elements (FIGS. 10A/10B), discrete fastener elements (FIGS. 7A/7B), sets of only a single fastener element type, mixed-type sets of fastener elements, and so forth.

As noted above, the sheet 300 and quilt 400 can be provided together as a set. Alternatively, the sheet 300 can be provided as an accessory or a retrofit for a quilt 400 that may or may not have been intended for use with the sheet 400.

Figure 9B:
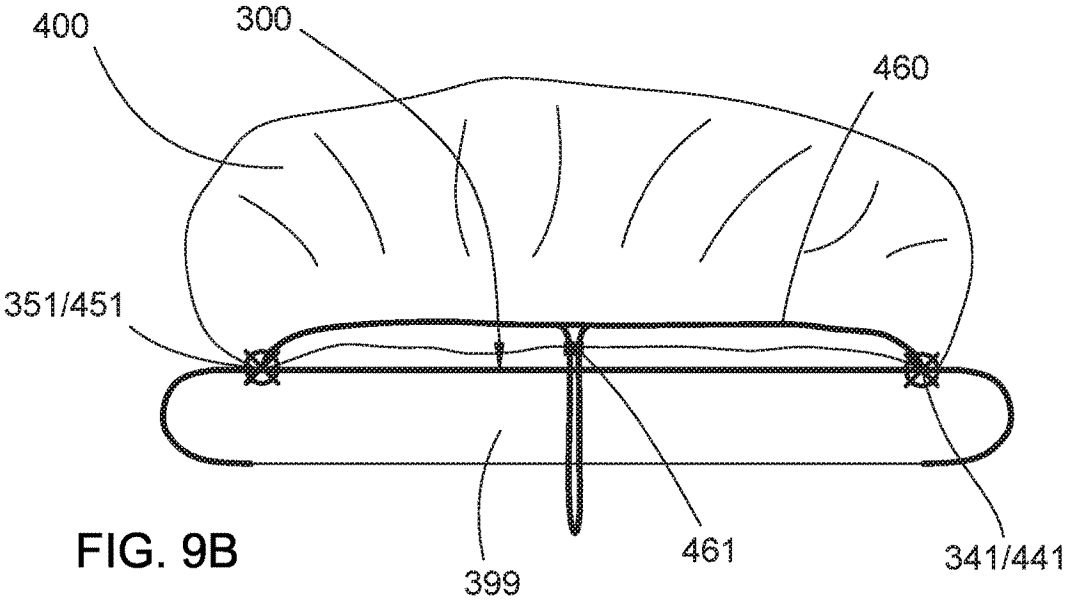
FIG. 9B is a schematic bottom view of the example quilt of FIG. 7A attached in a closed footbox-expanded arrangement to the example sheet of FIG. 7B.

If the quilt 400 includes a draw cord 460 across its bottom, footward edge, that draw cord typically is used, with the quilt fastener elements 441/451 engaged with each other, to gather the quilt bottom edge into a closed footbox of the sleeping bag (FIG. 8B); a draw cord retaining member 461 can be employed. When the quilt 400 is not attached to the sheet 300, that closed footbox can include a wrapped arrangement as described above, or can include non-overlapped attachment of the attachment paths 440/450 to form the closed footbox (FIGS. 8A/8B). With the quilt fastener elements 441/451 disengaged from each other and the quilt 400 attached to the sheet 300 in the footbox-expanded arrangement as described above (FIGS. 9A/9B), pulling the draw cord 460 gathers the quilt bottom edge to form a closed, expanded footbox of the sleeping bag (FIG. 9B). Depending on the conditions, the user may prefer to leave the expanded footbox open by not pulling the draw cord 460 (FIG. 9A).

The arrangements described enable a quilt 400 usable as a sleeping bag, including conventional quilts not necessarily intended for such use, to be readily converted between (i) an arrangement with a self-contained, closed footbox, and (ii) an arrangement having an expanded footbox that is attached to a sheet 300 (and therefore usually to a sleeping pad 399 on which the sheet 300 is deployed).

In addition to the preceding, the following examples fall within the scope of the present disclosure or appended claims:

Example 1. An article comprising: (a) a quilt usable as a sleeping bag and having (i) a quilt inner surface, (ii) a quilt outer surface, (iii) a headward quilt top edge, (iv) a footward quilt bottom edge, (v) a first quilt lateral edge, and (vi) a second quilt lateral edge opposite the first quilt lateral edge; (b) first and second pairs of discrete, mating bottom fastener elements attached to the quilt along the quilt bottom edge and structurally arranged so that (i) only one discrete bottom fastener element of the first pair is positioned between the discrete bottom fastener elements of the second pair, (ii)

only one discrete bottom fastener element of the second pair is positioned between the discrete bottom fastener elements of the first pair, and (iii) the first and second pairs of bottom fastener elements thereby define a first quilt bottom edge lateral segment between the first pair of bottom fastener elements but not between the second pair of bottom fastener elements, a second quilt bottom edge lateral segment between the second pair of bottom fastener elements but not between the first pair of bottom fastener elements, and a quilt bottom edge central segment between both pairs of bottom fastener elements; (c) an inner set of one or more quilt fastener elements attached to the quilt inner surface along at least a portion of a linear or curved inner quilt attachment path that extends from the first quilt lateral edge to the first quilt bottom edge lateral segment and defines on the quilt inner surface an inner quilt-overlap areal segment bounded by the inner quilt attachment path, the quilt bottom edge, and the first quilt lateral edge; (d) an outer set of one or more quilt fastener elements attached to the quilt outer surface along at least a portion of a linear or curved outer quilt attachment path that extends from the second quilt lateral edge to the second quilt bottom edge lateral segment and defines on the quilt outer surface an outer quilt-overlap areal segment bounded by the outer quilt attachment path, the quilt bottom edge, and the second quilt lateral edge; and (e) a draw cord engaged with the quilt bottom edge, wherein: (f) the inner and outer sets of quilt fastener elements and the inner and outer quilt attachment paths are structurally arranged so that, with the quilt wrapped in an overlapping footbox-wrapped arrangement, (i) the outer quilt-overlap areal segment faces a portion of the quilt inner surface, (ii) the inner quilt-overlap areal segment faces a portion of the quilt outer surface, (iii) each quilt fastener element of the inner set is substantially aligned with a corresponding, mating quilt fastener element of the outer set, and (iv) engagement of the corresponding mating quilt fastener elements of the inner and outer sets with each other retains at least a footward portion of the quilt in the overlapping footbox-wrapped arrangement; (g) with the quilt wrapped in the overlapping footbox-wrapped arrangement, (i) the first pair of mating bottom fastener elements is positioned so as to engage each other, (ii) the second pair of mating bottom fastener elements is positioned so as to engage each other, and (iii) engagement of the first pair of bottom fastener elements with each other and engagement of the second pair of bottom fastener elements with each other retain at least the quilt bottom edge in the overlapping footbox-wrapped arrangement with the first and second quilt bottom edge lateral segments overlapping each other; and (h) the draw cord and the quilt are structurally arranged so that, with the quilt retained in the overlapping footbox-wrapped arrangement by engagement of the first pair of bottom fastener elements with each other, engagement of the second pair of bottom fastener elements with each other, and engagement of the corresponding quilt fastener elements of the inner and outer sets with each other, pulling the draw cord gathers the quilt bottom edge to form a closed footbox of the sleeping bag.

Example 2. The article of Example 1 wherein either: (i) the quilt is substantially trapezoidal with the top and bottom edges substantially parallel and the bottom edge shorter than the top edge; or (ii) the quilt is substantially rectangular.

Example 3. The article of any one of Examples 1 or 2 wherein the draw cord or the quilt bottom edge is structurally arranged so as to secure the draw cord with the quilt bottom edge gathered, thereby securing the closed, wrapped footbox of the sleeping bag.

Example 4. The article of any one of Examples 1 through 3 wherein the draw cord includes a retaining member structurally arranged for securing the draw cord with the quilt bottom edge gathered, thereby securing the closed, wrapped footbox of the sleeping bag.

Example 5. The article of any one of Examples 1 through 4 wherein (i) the inner and outer quilt attachment paths are substantially linear, or (ii) the inner and outer quilt-overlap areal segments are substantially triangular.

Example 6. The article of any one of Examples 1 through 5 wherein (i) one discrete bottom fastener element of the first pair is positioned where the first quilt lateral edge meets the quilt bottom edge, (ii) one discrete bottom fastener element of the second pair is positioned where the second quilt lateral edge meets the quilt bottom edge, and (iii) the draw cord extends substantially entirely across the quilt bottom edge.

Example 7. The article of any one of Examples 1 through 6 wherein each pair of bottom fastener elements includes a cord loop and a hook structurally arranged so as to engage and retain the cord loop.

Example 8. The article of any one of Examples 1 through 6 wherein each pair of bottom fastener elements includes (i) a male snap element and a female snap element structurally arranged so as to engage and retain the male snap element, (ii) a button and a button hole structurally arranged so as to engage and retain the button, (iii) a male buckle or clasp element and a female buckle or clasp element structurally arranged so as to engage and retain the male buckle or clasp element, (iv) a circumscribed patch of hook material of a hook-and-loop material and a circumscribed patch of loop material of the hook-and-loop material, or (v) a pair of magnets.

Example 9. The article of any one of Examples 1 through 8 wherein: (c') the inner set of quilt fastener elements comprises a continuous quilt fastener element attached to the quilt inner surface along at least a portion of the inner quilt attachment path; and (d') the outer set of quilt fastener elements comprises a continuous quilt fastener element attached to the quilt outer surface along at least a portion of the outer quilt attachment path.

Example 10. The article of Example 9 wherein: (c') the inner set of quilt fastener elements comprises a first half of a zipper attached to the quilt inner surface along at least a portion of the inner quilt attachment path; and (d') the outer set of quilt fastener elements comprises a second half of the zipper attached to the quilt outer surface along at least a portion of the outer quilt attachment path.

Example 11. The article of Example 9 wherein: (c') the inner set of quilt fastener elements comprises a strip of hook material or loop material of a hook-and-loop material attached to the quilt inner surface along at least a portion of the inner quilt attachment path; and (d') the outer set of quilt fastener elements comprises a strip of hook material or loop material of a hook-and-loop material attached to the quilt outer surface along at least a portion of the outer quilt attachment path.

Example 12. The article of Example 9 wherein: (c') the inner set of quilt fastener elements comprises a first strip of magnetic plastic material attached to the quilt inner surface along at least a portion of the inner quilt attachment path; and (d') the outer set of quilt fastener elements comprises a second strip of magnetic plastic material attached to the quilt outer surface along at least a portion of the outer quilt attachment path.

Example 13. The article of any one of Examples 1 through 8 wherein: (c') the inner set of one or more quilt fastener elements comprises an inner set of multiple discrete quilt fastener elements attached to the quilt inner surface along at least a portion of the inner quilt attachment path; (d') the outer set of one or more quilt fastener elements comprises an outer set of multiple discrete quilt fastener elements attached to the quilt outer surface along at least a portion of the outer quilt attachment path; and (f') the inner and outer sets of quilt fastener elements and the inner and outer quilt attachment paths are structurally arranged so that, with the quilt wrapped in the overlapping footbox-wrapped arrangement, each discrete quilt fastener element of the inner set is substantially aligned with a corresponding, mating, discrete quilt fastener element of the outer set.

Example 14. The article of Example 13 wherein a topmost discrete quilt fastener element of the inner set is positioned on the first quilt lateral edge, and a topmost discrete quilt fastener element of the outer set is positioned on the second quilt lateral edge.

Example 15. The article of any one of Examples 13 or 14 wherein bottommost discrete quilt fastener elements of the inner and outer sets are displaced in a headward direction from the quilt bottom edge.

Example 16. The article of any one of Examples 13 through 15 wherein (i) each discrete quilt fastener element of the inner set comprises a cord loop or a hook structurally arranged so as to engage and retain a cord loop, (ii) for each cord loop among the inner set, the corresponding, aligned, mating, discrete quilt fastener element of the outer set comprises a hook, and (iii) for each hook among the inner set, the corresponding aligned, mating, discrete quilt fastener element of the outer set comprises a cord loop.

Example 17. The article of any one of Examples 13 through 15 wherein (i) each discrete quilt fastener element of the inner set comprises a male snap element or a female snap element structurally arranged so as to engage and retain the male snap element, (ii) for each male snap element among the inner set, the corresponding, aligned, mating, discrete quilt fastener element of the outer set comprises a female snap element, and (iii) for each female snap element among the inner set, the corresponding aligned, mating, discrete quilt fastener element of the outer set comprises a male snap element.

Example 18. The article of any one of Examples 13 through 15 wherein (i) each discrete quilt fastener element of the inner set comprises a button or a button hole structurally arranged so as to engage and retain a button, (ii) for each button among the inner set, the corresponding, aligned, mating, discrete quilt fastener element of the outer set comprises a button hole, and (iii) for each button hole among the inner set, the corresponding aligned, mating, discrete quilt fastener element of the outer set comprises a button.

Example 19. The article of any one of Examples 13 through 15 wherein (i) each discrete quilt fastener element of the inner set comprises a male buckle or clasp element or a female buckle or clasp element structurally arranged so as to engage and retain the male buckle or clasp element, (ii) for each male buckle or clasp element among the inner set, the corresponding, aligned, mating, discrete quilt fastener element of the outer set comprises a female buckle or clasp element, and (iii) for each female buckle or clasp element among the inner set, the corresponding aligned, mating, discrete quilt fastener element of the outer set comprises a male buckle or clasp element.

Example 20. The article of any one of Examples 13 through 15 wherein (i) each discrete quilt fastener element of the inner set comprises a circumscribed patch of hook material or loop material of a hook-and-loop material, (ii) for each patch of hook material among the inner set, the corresponding, aligned, mating, discrete quilt fastener element of the outer set comprises a patch of loop material, and (iii) for each patch of loop material among the inner set, the corresponding aligned, mating, discrete quilt fastener element of the outer set comprises a patch of hook material.

Example 21. The article of any one of Examples 13 through 15 wherein each discrete quilt fastener element of the inner and outer sets comprises a magnet.

Example 22. The article of any one of Examples 13 through 21 further comprising: (a) an additional set of multiple discrete quilt fastener elements attached to the quilt outer surface along at least a portion of a linear or curved additional quilt attachment path that extends from the first quilt lateral edge to the quilt bottom edge and defines on the quilt outer surface an additional quilt-overlap areal segment bounded by the additional outer quilt attachment path, the quilt bottom edge, and the first quilt lateral edge; and (b) a sheet structurally arranged to be secured to a sleeping pad and including on a sheet outer surface thereof first and second sets of multiple discrete sheet fastener elements structurally arranged along corresponding linear or curved first and second sheet attachment paths, wherein: (c) the first and second attachment paths are structurally arranged generally longitudinally along at least corresponding footward portions of respective first and second lateral edges of the sheet; (d) the outer and additional sets of discrete quilt fastener elements, the outer and additional quilt attachment paths, the first and second sets of discrete sheet fastener elements, and the first and second sheet attachment paths are structurally arranged so that, with (1) the first and second pairs of bottom fastener elements disengaged from each other, (2) the inner and outer sets of quilt fastener elements disengaged from each other, and (3) the quilt in a footbox-expanded arrangement and positioned with the quilt inner surface facing the sheet outer surface, (i) the outer and additional quilt-overlap areal segments face corresponding portions of the sheet outer surface, (ii) each discrete quilt fastener element of the outer set is substantially aligned with a corresponding, mating, discrete sheet fastener element of the first set, (iii) each discrete quilt fastener element of the additional set is substantially aligned with a corresponding, mating, discrete sheet fastener element of the second set, and (iv) engagement of the corresponding mating quilt and sheet fastener elements of the respective outer and first sets with each other, and engagement of the corresponding mating quilt and sheet fastener elements of the respective additional and second sets with each other, retain at least a footward portion of the quilt secured to the sheet in the footbox-expanded arrangement; and (e) the draw cord and the quilt are structurally arranged so that, with the quilt retained in the footbox-expanded arrangement by engagement of the corresponding mating discrete quilt and sheet fastener elements of the respective outer and first sets with each other, and engagement of the corresponding mating discrete quilt and sheet fastener elements of the respective additional and second sets with each other, pulling the draw cord gathers the quilt bottom edge to form a closed, expanded footbox of the sleeping bag.

Example 23. The article of Example 22 wherein the first and second sheet attachment paths are (i) positioned on respective first and second sheet lateral edges, or (ii) displaced medially from the respective first and second sheet lateral edges.

Example 24. The article of any one of Examples 22 or 23 wherein a topmost discrete quilt fastener element of the inner set is also a topmost discrete quilt fastener element of the additional set.

Example 25. The article of any one of Examples 22 through 24 wherein (i) each discrete quilt fastener element of the outer and additional sets comprises a cord loop or a hook structurally arranged so as to engage and retain a cord loop, (ii) for each cord loop among the outer and additional sets, the corresponding, aligned, mating, discrete sheet fastener element of the first or second set comprises a hook, and (iii) for each hook among the outer and additional sets, the corresponding aligned, mating, discrete sheet fastener element of the first or second set comprises a cord loop.

Example 26. The article of any one of Examples 22 through 24 wherein (i) each discrete quilt fastener element of the outer and additional sets comprises a male snap element or a female snap element structurally arranged so as to engage and retain the male snap element, (ii) for each male snap element among the outer and additional sets, the corresponding, aligned, mating, discrete sheet fastener element of the first or second set comprises a female snap element, and (iii) for each female snap element among the outer and additional sets, the corresponding aligned, mating, discrete sheet fastener element of the first or second set comprises a male snap element.

Example 27. The article of any one of Examples 22 through 24 wherein (i) each discrete quilt fastener element of the outer and additional sets comprises a button or a button hole structurally arranged so as to engage and retain a button, (ii) for each button among the outer and additional sets, the corresponding, aligned, mating, discrete sheet fastener element of the first or second set comprises a button hole, and (iii) for each button hole among the outer and additional sets, the corresponding aligned, mating, discrete sheet fastener element of the first or second set comprises a button.

Example 28. The article of any one of Examples 22 through 24 wherein (i) each discrete quilt fastener element of the outer and additional sets comprises a male buckle or clasp element or a female buckle or clasp element structurally arranged so as to engage and retain the male buckle or clasp element, (ii) for each male buckle or clasp element among the outer and additional sets, the corresponding, aligned, mating, discrete sheet fastener element of the first or second set comprises a female buckle or clasp element, and (iii) for each female buckle or clasp element among the outer and additional sets, the corresponding aligned, mating, discrete sheet fastener element of the first or second set comprises a male buckle or clasp element.

Example 29. The article of any one of Examples 22 through 24 wherein (i) each discrete quilt fastener element of the outer and additional sets comprises a circumscribed patch of hook material or loop material of a hook-and-loop material, (ii) for each patch of hook material among the outer and additional sets, the corresponding, aligned, mating, discrete sheet fastener element of the first or second set comprises a patch of loop material, and (iii) for each patch of loop material among the outer and additional sets, the corresponding aligned, mating, discrete sheet fastener element of the first or second set comprises a patch of hook material.

Example 30. The article of any one of Examples 22 through 24 wherein each discrete quilt fastener element of the outer and additional sets comprises a magnet, and each discrete sheet fastener element of the first and second sets comprises a magnet.

Example 31. The article of any one of Examples 13 through 21 further comprising: (a) an additional set of one or more quilt fastener elements attached to the quilt outer surface along at least a portion of a linear or curved additional quilt attachment path that extends from the first quilt lateral edge to the first quilt bottom edge lateral segment and defines on the quilt outer surface an additional quilt-overlap areal segment bounded by the additional outer quilt attachment path, the quilt bottom edge, and the first quilt lateral edge; and (b) a sheet structurally arranged to be secured to a sleeping pad and including on a sheet outer thereof first and second sets of one or more sheet fastener elements structurally arranged along corresponding linear or curved first and second sheet attachment paths, wherein: (c) the first and second attachment paths are structurally arranged along at least corresponding footward portions of respective first and second lateral edges of the sheet; (d) the outer and additional sets of quilt fastener elements, the outer and additional quilt attachment paths, the first and second sets of sheet fastener elements, and the first and second sheet attachment paths are structurally arranged so that, with (1) the first and second pairs of bottom fastener elements disengaged from each other, (2) the inner and outer sets of quilt fastener elements disengaged from each other, and (3) the quilt in a footbox-expanded arrangement and positioned over the sheet with the quilt inner surface facing the sheet outer surface, (i) the outer and additional quilt-overlap areal segments face corresponding portions of the sheet outer surface, (ii) each quilt fastener element of the outer set is substantially aligned with a corresponding, mating sheet fastener element of the first set, (iii) each quilt fastener element of the additional set is substantially aligned with a corresponding, mating sheet fastener element of the second set, and (iv) engagement of the corresponding mating quilt and sheet fastener elements of the respective outer and first sets with each other, and engagement of the corresponding mating quilt and sheet fastener elements of the respective additional and second sets with each other, retain at least a footward portion of the quilt secured to the sheet in the footbox-expanded arrangement; and (e) the draw cord and the quilt are structurally arranged so that, with the quilt retained in the footbox-expanded arrangement by engagement of the corresponding mating quilt and sheet fastener elements of the respective outer and first sets with each other, and engagement of the corresponding mating quilt and sheet fastener elements of the respective additional and second sets with each other, pulling the draw cord gathers the quilt bottom edge to form a closed, expanded footbox of the sleeping bag.

Example 32. The article of Example 31 wherein the first and second sheet attachment paths are (i) positioned on respective first and second sheet lateral edges, or (ii) displaced medially from the respective first and second sheet lateral edges.

Example 33. The article of any one of Examples 31 or 32 wherein: (i) the inner set of quilt fastener elements comprises a continuous quilt fastener element attached to the quilt inner surface along at least a portion of the inner quilt attachment path; (ii) the outer set of quilt fastener elements comprises a continuous quilt fastener element attached to the quilt outer surface along at least a portion of the outer quilt attachment path; (iii) the additional set of quilt fastener elements comprises a continuous quilt fastener element attached to the quilt outer surface along at least a portion of the additional quilt attachment path; (iv) the first set of sheet fastener elements comprises a continuous sheet fastener element attached to the sheet outer surface along the first sheet attachment path; and (v) the second set of sheet fastener elements comprises a continuous sheet fastener element attached to the sheet outer surface along the second sheet attachment path.

Example 34. The article of Example 33 wherein: (i) the inner set of quilt fastener elements comprises a half zipper attached to the quilt inner surface along at least a portion of the inner quilt attachment path; (ii) the outer set of quilt fastener elements comprises a half zipper attached to the quilt outer surface along at least a portion of the outer quilt attachment path; (iii) the additional set of quilt fastener elements comprises a half zipper attached to the quilt outer surface along at least a portion of the additional quilt attachment path; (iv) the first set of sheet fastener elements comprises a half zipper attached to the sheet outer surface along the first sheet attachment path; and (v) the second set of sheet fastener elements comprises a half zipper attached to the sheet outer surface along the second sheet attachment path.

Example 35. The article of Example 33 wherein: (i) the inner set of quilt fastener elements comprises a strip of hook material or loop material of a hook-and-loop material attached to the quilt inner surface along at least a portion of the inner quilt attachment path; (ii) the outer set of quilt fastener elements comprises a strip of hook material or loop material of a hook-and-loop material attached to the quilt outer surface along at least a portion of the outer quilt attachment path; (iii) the additional set of quilt fastener elements comprises a strip of hook material or loop material of a hook-and-loop material attached to the quilt outer surface along at least a portion of the additional quilt attachment path; (iv) the first set of sheet fastener elements comprises a strip of hook material or loop material of a hook-and-loop material attached to the sheet outer surface along the first sheet attachment path; and (v) the second set of sheet fastener elements comprises a strip of hook material or loop material of a hook-and-loop material attached to the sheet outer surface along the second sheet attachment path.

Example 36. The article of Example 33 wherein: (i) the inner set of quilt fastener elements comprises a strip of magnetic plastic material attached to the quilt inner surface along at least a portion of the inner quilt attachment path; (ii) the outer set of quilt fastener elements comprises a strip of magnetic plastic material attached to the quilt outer surface along at least a portion of the outer quilt attachment path; (iii) the additional set of quilt fastener elements comprises a strip of magnetic plastic material attached to the quilt outer surface along at least a portion of the additional quilt attachment path; (iv) the first set of sheet fastener elements comprises a strip of magnetic plastic material attached to the sheet outer surface along the first sheet attachment path; and (v) the second set of sheet fastener elements comprises a strip of magnetic plastic material attached to the sheet outer surface along the second sheet attachment path.

Example 37. A method for using the article of any one of Examples 22 through 36, the method comprising: (A) positioning the quilt with the quilt inner surface facing the sheet outer surface with (i) the quilt in the footbox-expanded arrangement, (ii) the outer and additional quilt-overlap areal segments face corresponding portions of the sheet outer surface, (iii) each quilt fastener element of the outer set is substantially aligned with a corresponding, mating sheet fastener element of the first set, and (iv) each quilt fastener element of the additional set is substantially aligned with a corresponding, mating sheet fastener element of the second set; and (B) engaging the corresponding mating quilt and sheet fastener elements of the respective outer and first sets with each other, and engaging the corresponding mating quilt and sheet fastener elements of the respective additional and second sets with each other, thereby retaining at least a footward portion of the quilt secured to the sheet in the footbox-expanded arrangement.

Example 38. The method of Example 37, the method further comprising, before part (A), (i) disengaging from each other the first and second pairs of bottom fastener elements, and (ii) disengaging from each other the inner and outer sets of quilt fastener elements.

Example 39. The method of any one of Examples 37 or 38, the method further comprising, after part (B), pulling the draw cord so as to gather the quilt bottom edge to form the closed, expanded footbox of the sleeping bag.

Example 40. A method for using the article of any one of Examples 22 through 36, the method comprising: (A) disengaging from each other the corresponding mating quilt and sheet fastener elements of the outer and first sets, respectively; (B) disengaging from each other the corresponding mating quilt and sheet fastener elements of the additional and second sets, respectively; (C) wrapping at least a footward portion of the quilt into the overlapping footbox-wrapped arrangement with (i) the outer quilt-overlap areal segment facing a portion of the quilt inner surface, (ii) the inner quilt-overlap areal segment facing a portion of the quilt outer surface, (iii) the inner and outer quilt attachment paths substantially aligned with each other, and (iv) each quilt fastener element of the inner set substantially aligned with the corresponding, mating quilt fastener element of the outer set; (D) engaging the first pair of bottom fastener elements with each other and engaging the second pair of bottom fastener elements with each other, thereby retaining at least the quilt bottom edge in the overlapping footbox-wrapped arrangement; (E) engaging corresponding mating quilt fastener elements of the inner and outer sets with each other, thereby retaining at least a footward portion of the quilt in the overlapping footbox-wrapped arrangement; and (F) pulling the draw cord so as to gather the quilt bottom edge and form the closed, wrapped footbox of the sleeping bag.

Example 41. A method for using the article of any one of Examples 1 through 36, the method comprising: (A) wrapping at least a footward portion of the quilt into the overlapping footbox-wrapped arrangement with (i) the outer quilt-overlap areal segment facing a portion of the quilt inner surface, (ii) the inner quilt-overlap areal segment facing a portion of the quilt outer surface, and (iii) each quilt fastener element of the inner set substantially aligned with the corresponding, mating quilt fastener element of the outer set; (B) engaging the first pair of bottom fastener elements with each other and engaging the second pair of bottom fastener elements with each other, thereby retaining at least the quilt bottom edge in the overlapping footbox-wrapped arrangement with the first and second quilt bottom edge lateral segments overlapping each other; (C) engaging corresponding mating quilt fastener elements of the inner and outer sets with each other, thereby retaining at least a footward portion of the quilt in the overlapping footbox-wrapped arrangement; and (D) pulling the draw cord so as to gather the quilt bottom edge and form the closed, wrapped footbox of the sleeping bag.

Example 42. An article for use with a sleeping bag, the article comprising: (a) a sheet structurally arranged to be secured to a sleeping pad; (b) a first set of one or more sheet fastener elements attached to a sheet outer surface and structurally arranged along a linear or curved first sheet attachment path on the sheet outer surface; and (c) a second set of one or more sheet fastener elements attached to the sheet outer surface and structurally arranged along a linear or curved second sheet attachment path on the sheet outer surface, wherein: (c) the first and second attachment paths are structurally arranged generally longitudinally along at least corresponding footward portions of respective first and second lateral edges of the sheet; (d) the first and second sets of sheet fastener elements and the first and second sheet attachment paths are structurally arranged so as to enable (i) the first set of sheet fastener elements and a corresponding first set of quilt fastener elements of a quilt usable as a sleeping bag to engage each other, and (ii) the second set of sheet fastener elements and a corresponding second set of quilt fastener elements of the quilt to engage each other; and (e) the first and second sets of sheet fastener elements and the first and second sheet attachment paths are structurally arranged so that, with the quilt in an unwrapped arrangement with the first and second sets of quilt fastener elements disengaged from each other, and with the quilt positioned over the sheet with a quilt inner surface facing the sheet outer surface, (i) each quilt fastener element of the first set is substantially aligned with a corresponding, mating sheet fastener element of the first set, (iii) each quilt fastener element of the second set is substantially aligned with a corresponding, mating sheet fastener element of the second set, and (iv) engagement of the corresponding mating quilt and sheet fastener elements of the respective first sets with each other, and engagement of the corresponding mating quilt and sheet fastener elements of the respective second sets with each other, retain at least a footward portion of the quilt secured to the sheet in a footbox-expanded arrangement.

Example 43. The article of Example 42 wherein the first and second sheet attachment paths are (i) positioned on respective first and second sheet lateral edges, or (ii) displaced medially from the respective first and second sheet lateral edges.

Example 44. The article of any one of Examples 42 or 43 wherein: (i) the first set of sheet fastener elements comprises a continuous sheet fastener element attached to the sheet outer surface along the first sheet attachment path; and (ii) the second set of sheet fastener elements comprises a continuous sheet fastener element attached to the sheet outer surface along the second sheet attachment path.

Example 45. The article of Example 44 wherein: (i) the first set of sheet fastener elements comprises a half zipper attached to the sheet outer surface along the first sheet attachment path; and (ii) the second set of sheet fastener elements comprises a half zipper attached to the sheet outer surface along the second sheet attachment path.

Example 46. The article of Example 44 wherein: (i) the first set of sheet fastener elements comprises a strip of hook material or loop material of a hook-and-loop material attached to the sheet outer surface along the first sheet attachment path; and (ii) the second set of sheet fastener elements comprises a strip of hook material or loop material of a hook-and-loop material attached to the sheet outer surface along the second sheet attachment path.

Example 47. The article of Example 44 wherein: (i) the first set of sheet fastener elements comprises a strip of magnetic plastic material attached to the sheet outer surface along the first sheet attachment path; and (ii) the second set of sheet fastener elements comprises a strip of magnetic plastic material attached to the sheet outer surface along the second sheet attachment path.

Example 48. The article of any one of Examples 42 of 43 wherein: (i) the first set of sheet fastener elements comprises a first set of multiple discrete sheet fastener elements attached to the sheet outer surface along the first sheet attachment path; and (ii) the second set of sheet fastener elements comprises a second set of multiple discrete sheet fastener elements attached to the sheet outer surface along the second sheet attachment path.

Example 49. The article of Example 48 wherein (i) each discrete sheet fastener element of the first set comprises a cord loop or a hook structurally arranged so as to engage and retain a cord loop, and (ii) each discrete sheet fastener element of the second set comprises a cord loop or a hook structurally arranged so as to engage and retain a cord loop.

Example 50. The article of Example 48 wherein (a) each discrete sheet fastener element of the first set comprises (i) a male snap element or a female snap element structurally arranged so as to engage and retain a male snap element, (ii) a button or a button hole structurally arranged so as to engage and retain a button, (iii) a male buckle or clasp element or a female buckle or clasp element structurally arranged so as to engage and retain a male buckle or clasp element, (iv) a circumscribed patch of hook material of a hook-and-loop material or a circumscribed patch of loop material of the hook-and-loop material, or (v) a magnet, and (b) each discrete sheet fastener element of the second set comprises (i) a male snap element or a female snap element structurally arranged so as to engage and retain a male snap element, (ii) a button or a button hole structurally arranged so as to engage and retain a button, (iii) a male buckle or clasp element or a female buckle or clasp element structurally arranged so as to engage and retain a male buckle or clasp element, (iv) a circumscribed patch of hook material of a hook-and-loop material or a circumscribed patch of loop material of the hook-and-loop material, or (v) a magnet.

Example 51. The article of any one of Examples 42 through 50 further comprising: (a) the quilt usable as a sleeping bag; (b) the first set of one or more quilt fastener elements attached to the quilt and structurally arranged along a linear or curved first quilt attachment path on the quilt; and (c) the second set of one or more quilt fastener elements attached to the quilt and structurally arranged along a linear or curved second quilt attachment path on the quilt, wherein: (d) the first and second sets of quilt fastener elements and the first and second quilt attachment paths are structurally arranged so that, with at least a footward portion of the quilt in a foot-box wrapped arrangement, engagement of the first and second sets of quilt fastener elements with each other retains at least a footward portion of the quilt in a footbox-wrapped arrangement; and (e) the first and second sets of quilt fastener elements and the first and second quilt attachment paths are structurally arranged so that, with the quilt in an unwrapped arrangement with the first and second sets of quilt fastener elements disengaged from each other, and with the quilt positioned over the sheet with the quilt inner surface facing the sheet outer surface, (i) each quilt fastener element of the first set is substantially aligned with a corresponding, mating sheet fastener element of the first set, (iii) each quilt fastener element of the second set is substantially aligned with a corresponding, mating sheet fastener element of the second set, and (iv) engagement of the corresponding mating quilt and sheet fastener elements of the respective first sets with each other, and engagement of the corresponding mating quilt and sheet fastener elements of the respective second sets with each other, retain at least a footward portion of the quilt secured to the sheet in a footbox-expanded arrangement.

Example 52. The article of Example 51 wherein the first and second quilt attachment paths are (i) positioned on respective first and second quilt lateral edges, (ii) displaced medially from the respective first and second quilt lateral edges on the quilt inner surface, or (iii) displaced medially from the respective first and second quilt lateral edges on a quilt outer surface.

Example 53. The article of any one of Examples 51 or 52 further comprising a draw cord engaged with and extending across at least a portion of a bottom, footward edge of the quilt, wherein: (a) the draw cord and the quilt are structurally arranged so that, with the quilt retained in the footbox-wrapped arrangement by engagement of the first and second sets of quilt fastener elements with each other, pulling the draw cord gathers the quilt bottom edge to form a closed, wrapped footbox of the sleeping bag; and (b) the draw cord and the quilt are structurally arranged so that, with the quilt retained in the footbox-expanded arrangement by engagement of the corresponding mating quilt and sheet fastener elements of the respective first sets with each other, and engagement of the corresponding mating quilt and sheet fastener elements of the respective second sets with each other, pulling the draw cord gathers at least a portion of the quilt bottom edge to form a closed, expanded footbox of the sleeping bag.

Example 54. The article of Example 53 wherein the draw cord extends substantially entirely across the quilt bottom edge.

Example 55. The article of any one of Examples 53 or 54 wherein the draw cord or the quilt bottom edge is structurally arranged so as to secure the draw cord with the quilt bottom edge gathered, thereby securing the closed, wrapped footbox of the sleeping bag.

Example 56. The article of any one of Examples 53 through 55 wherein the draw cord includes a retaining member structurally arranged for securing the draw cord with the quilt bottom edge gathered, thereby securing the closed, wrapped footbox of the sleeping bag.

Example 57. The article of any one of Examples 51 through 56 wherein: (i) the first set of quilt fastener elements comprises a continuous quilt fastener element attached to the quilt along the first quilt attachment path; (ii) the second set of quilt fastener elements comprises a continuous quilt fastener element attached to the quilt along the second quilt attachment path; (iii) the first set of sheet fastener elements comprises a continuous sheet fastener element attached to the sheet outer surface along the first sheet attachment path; and (iv) the second set of sheet fastener elements comprises a continuous sheet fastener element attached to the sheet outer surface along the second sheet attachment path.

Example 58. The article of Example 57 wherein: (i) the first set of quilt fastener elements comprises a half zipper attached to the quilt along the first quilt attachment path; (ii) the second set of quilt fastener elements comprises a half zipper attached to the quilt along the second quilt attachment path; (iii) the first set of sheet fastener elements comprises a half zipper attached to the sheet outer surface along the first sheet attachment path; and (iv) the second set of sheet fastener elements comprises a half zipper attached to the sheet outer surface along the second sheet attachment path.

Example 59. The article of Example 57 wherein: (i) the first set of quilt fastener elements comprises a strip of hook material or loop material of a hook-and-loop material attached to the quilt along the first quilt attachment path; (ii) the second set of quilt fastener elements comprises a strip of hook material or loop material of a hook-and-loop material attached to the quilt along the second quilt attachment path; (iii) the first set of sheet fastener elements comprises a strip of hook material or loop material of a hook-and-loop material attached to the sheet outer surface along the first sheet attachment path; and (iv) the second set of sheet fastener elements comprises a strip of hook material or loop material of a hook-and-loop material attached to the sheet outer surface along the second sheet attachment path.

Example 60. The article of Example 57 wherein: (i) the first set of quilt fastener elements comprises a strip of magnetic plastic material attached to the quilt along the first quilt attachment path; (ii) the second set of quilt fastener elements comprises a strip of magnetic plastic material attached to the quilt along the second quilt attachment path; (iii) the first set of sheet fastener elements comprises a strip of magnetic plastic material attached to the sheet outer surface along the first sheet attachment path; and (iv) the second set of sheet fastener elements comprises a strip of magnetic plastic material attached to the sheet outer surface along the second sheet attachment path.

Example 61. The article of any one of Examples 51 through 56 wherein: (i) the first set of quilt fastener elements comprises a first set of multiple discrete quilt fastener elements attached to the quilt along the first quilt attachment path; (ii) the second set of quilt fastener elements comprises a second set of multiple discrete quilt fastener elements attached to the quilt along the second quilt attachment path; (iii) the first set of sheet fastener elements comprises a first set of multiple discrete sheet fastener elements attached to the sheet outer surface along the first sheet attachment path; and (iv) the second set of sheet fastener elements comprises a second set of multiple discrete sheet fastener elements attached to the sheet outer surface along the second sheet attachment path.

Example 62. The article of Example 61 wherein (i) each discrete quilt fastener element of the first and second sets comprises a cord loop or a hook structurally arranged so as to engage and retain a cord loop, (ii) for each cord loop among the first and second sets of discrete quilt fastener elements, the corresponding, aligned, mating, discrete sheet fastener element of the first or second set comprises a hook, and (iii) for each hook among the first and second sets of discrete quilt fastener elements, the corresponding aligned, mating, discrete sheet fastener element of the first or second set comprises a cord loop.

Example 63. The article of Example 61 wherein (i) each discrete quilt fastener element of the first and second sets comprises a male snap element or a female snap element structurally arranged so as to engage and retain the male snap element, (ii) for each male snap element among the first and second sets of discrete quilt fastener elements, the corresponding, aligned, mating, discrete sheet fastener element of the first or second set comprises a female snap element, and (iii) for each female snap element among the first and second sets of discrete quilt fastener elements, the corresponding aligned, mating, discrete sheet fastener element of the first or second set comprises a male snap element.

Example 64. The article of Example 61 wherein (i) each discrete quilt fastener element of the first and second sets comprises a button or a button hole structurally arranged so as to engage and retain a button, (ii) for each button among the first and second sets of discrete quilt fastener elements, the corresponding, aligned, mating, discrete sheet fastener element of the first or second set comprises a button hole, and (iii) for each button hole among the first and second sets of discrete quilt fastener elements, the corresponding aligned, mating, discrete sheet fastener element of the first or second set comprises a button.

Example 65. The article of Example 61 wherein (i) each discrete quilt fastener element of the first and second sets comprises a male buckle or clasp element or a female buckle or clasp element structurally arranged so as to engage and retain the male buckle or clasp element, (ii) for each male buckle or clasp element among the first and second sets of discrete quilt fastener elements, the corresponding, aligned, mating, discrete sheet fastener element of the first or second set comprises a female buckle or clasp element, and (iii) for each female buckle or clasp element among the first and second sets of discrete quilt fastener elements, the corresponding aligned, mating, discrete sheet fastener element of the first or second set comprises a male buckle or clasp element.

Example 66. The article of Example 61 wherein (i) each discrete quilt fastener element of the first and second sets comprises a circumscribed patch of hook material or loop material of a hook-and-loop material, (ii) for each patch of hook material among the first and second sets of discrete quilt fastener elements, the corresponding, aligned, mating, discrete sheet fastener element of the first or second set comprises a patch of loop material, and (iii) for each patch of loop material among the first and second sets of discrete quilt fastener elements, the corresponding aligned, mating, discrete sheet fastener element of the first or second set comprises a patch of hook material.

Example 67. The article of Example 61 wherein each discrete quilt fastener element of the first and second sets comprises a magnet, and each discrete sheet fastener element of the first and second sets comprises a magnet.

Example 68. A method for using the article of any one of Examples 51 through 67, the method comprising: (A) positioning the quilt with the quilt inner surface facing the sheet outer surface with (i) the quilt in the footbox-expanded arrangement, (ii) each quilt fastener element of the first set substantially aligned with a corresponding, mating sheet fastener element of the first set, and (iii) each quilt fastener element of the second set substantially aligned with a corresponding, mating sheet fastener element of the second set; and (B) engaging the corresponding mating quilt and sheet fastener elements of the respective first sets with each other, and engaging the corresponding mating quilt and sheet fastener elements of the respective second sets with each other, thereby retaining at least a footward portion of the quilt secured to the sheet in the footbox-expanded arrangement.

Example 69. The method of Example 68, the method further comprising, before part (A), disengaging from each other the quilt fastener elements of the first and second sets.

Example 70. The method of any one of Examples 68 or 69, the method comprising, after part (B), pulling the draw cord so as to gather at least a portion of the quilt bottom edge to form the closed, expanded footbox of the sleeping bag.

Example 71. The method any one of Examples 68 through 70, the method comprising, after part (B), pulling the draw cord so as to gather at least a portion of the quilt bottom edge to form a closed footbox of the sleeping bag.

Example 72. The method any one of Examples 68 through 70, the method further comprising, after part (B): (C) disengaging from each other the quilt and sheet fastener elements of the respective first sets; (D) disengaging from each other the quilt and sheet fastener elements of the respective second sets; (E) wrapping or folding at least a footward portion of the quilt into the footbox-wrapped arrangement; and (F) engaging with each other the quilt fastener elements of the first and second sets, thereby retaining at least a footward portion of the quilt in the footbox-wrapped arrangement.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore the present disclosure shall be construed as implicitly disclosing any embodiment having any suitable set of one or more features—which features are shown, described, or claimed in the present application—including those sets that may not be explicitly disclosed herein. A "suitable" set of features includes only features that are neither incompatible nor mutually exclusive with respect to any other feature of the set. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the scope of the appended claims can, but does not necessarily, encompass the whole of the subject matter disclosed in the present application.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise. For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An article comprising:

(a) a quilt usable as a sleeping bag and having (i) a quilt inner surface, (ii) a quilt outer surface, (iii) a headward quilt top edge, (iv) a footward quilt bottom edge, (v) a first quilt lateral edge, and (vi) a second quilt lateral edge opposite the first quilt lateral edge;

(b) first and second pairs of discrete, mating bottom fastener elements attached to the quilt along the quilt bottom edge and structurally arranged so that (i) only one discrete bottom fastener element of the first pair is positioned between the discrete bottom fastener elements of the second pair, (ii) only one discrete bottom fastener element of the second pair is positioned between the discrete bottom fastener elements of the first pair, and (iii) the first and second pairs of bottom fastener elements thereby define a first quilt bottom edge lateral segment between the first pair of bottom fastener elements but not between the second pair of bottom fastener elements, a second quilt bottom edge lateral segment between the second pair of bottom fastener elements but not between the first pair of bottom fastener elements, and a quilt bottom edge central segment between both pairs of bottom fastener elements;

(c) an inner set of one or more quilt fastener elements attached to the quilt inner surface along at least a portion of a linear or curved inner quilt attachment path that extends from the first quilt lateral edge to the first quilt bottom edge lateral segment and defines on the quilt inner surface an inner quilt-overlap areal segment bounded by the inner quilt attachment path, the quilt bottom edge, and the first quilt lateral edge;

(d) an outer set of one or more quilt fastener elements attached to the quilt outer surface along at least a portion of a linear or curved outer quilt attachment path that extends from the second quilt lateral edge to the second quilt bottom edge lateral segment and defines on the quilt outer surface an outer quilt-overlap areal segment bounded by the outer quilt attachment path, the quilt bottom edge, and the second quilt lateral edge; and (e) a draw cord engaged with the quilt bottom edge, wherein:

(f) the inner and outer sets of quilt fastener elements and the inner and outer quilt attachment paths are structurally arranged so that, with the quilt wrapped in an overlapping footbox-wrapped arrangement, (i) the outer quilt-overlap areal segment faces a portion of the quilt inner surface, (ii) the inner quilt-overlap areal segment faces a portion of the quilt outer surface, (iii) each quilt fastener element of the inner set is substantially aligned with a corresponding, mating quilt fastener element of the outer set, and (iv) engagement of the corresponding mating quilt fastener elements of the inner and outer sets with each other retains at least a footward portion of the quilt in the overlapping footbox-wrapped arrangement;

(g) with the quilt wrapped in the overlapping footbox-wrapped arrangement, (i) the first pair of mating bottom fastener elements is positioned so as to engage each other, (ii) the second pair of mating bottom fastener elements is positioned so as to engage each other, and (iii) engagement of the first pair of bottom fastener elements with each other and engagement of the second pair of bottom fastener elements with each other retain at least the quilt bottom edge in the overlapping footbox-wrapped arrangement with the first and second quilt bottom edge lateral segments overlapping each other; and (h) the draw cord and the quilt are structurally arranged so that, with the quilt retained in the overlapping footbox-wrapped arrangement by engagement of the first pair of bottom fastener elements with each other, engagement of the second pair of bottom fastener elements with each other, and engagement of the corresponding quilt fastener elements of the inner and outer sets with each other, pulling the draw cord gathers the quilt bottom edge to form a closed footbox of the sleeping bag.

2. The article of claim 1 wherein (i) one discrete bottom fastener element of the first pair is positioned where the first quilt lateral edge meets the quilt bottom edge, (ii) one discrete bottom fastener element of the second pair is positioned where the second quilt lateral edge meets the quilt bottom edge, and (iii) the draw cord extends substantially entirely across the quilt bottom edge.

3. The article of claim 1 wherein each pair of bottom fastener elements includes a cord loop and a hook structurally arranged so as to engage and retain the cord loop.

4. The article of claim 1 wherein:

(c') the inner set of quilt fastener elements comprises a continuous quilt fastener element attached to the quilt inner surface along at least a portion of the inner quilt attachment path; and (d') the outer set of quilt fastener elements comprises a continuous quilt fastener element attached to the quilt outer surface along at least a portion of the outer quilt attachment path.

5. The article of claim 4 wherein:

(c') the inner set of quilt fastener elements comprises a first half of a zipper attached to the quilt inner surface along at least a portion of the inner quilt attachment path; and (d') the outer set of quilt fastener elements comprises a second half of the zipper attached to the quilt outer surface along at least a portion of the outer quilt attachment path.

6. The article of claim 1 wherein:

(c') the inner set of one or more quilt fastener elements comprises an inner set of multiple discrete quilt fastener elements attached to the quilt inner surface along at least a portion of the inner quilt attachment path;

(d') the outer set of one or more quilt fastener elements comprises an outer set of multiple discrete quilt fastener elements attached to the quilt outer surface along at least a portion of the outer quilt attachment path; and (f') the inner and outer sets of quilt fastener elements and the inner and outer quilt attachment paths are structurally arranged so that, with the quilt wrapped in the overlapping footbox-wrapped arrangement, each discrete quilt fastener element of the inner set is substantially aligned with a corresponding, mating, discrete quilt fastener element of the outer set.

7. The article of claim 6 wherein bottommost discrete quilt fastener elements of the inner and outer sets are displaced in a headward direction from the quilt bottom edge.

8. The article of claim 6 wherein (i) each discrete quilt fastener element of the inner set comprises a cord loop or a hook structurally arranged so as to engage and retain a cord loop, (ii) for each cord loop among the inner set, the corresponding, aligned, mating, discrete quilt fastener element of the outer set comprises a hook, and (iii) for each hook among the inner set, the corresponding aligned, mating, discrete quilt fastener element of the outer set comprises a cord loop.

9. The article of claim 6 further comprising:

(a) an additional set of multiple discrete quilt fastener elements attached to the quilt outer surface along at least a portion of a linear or curved additional quilt attachment path that extends from the first quilt lateral edge to the quilt bottom edge and defines on the quilt outer surface an additional quilt-overlap areal segment bounded by the additional outer quilt attachment path, the quilt bottom edge, and the first quilt lateral edge; and (b) a sheet structurally arranged to be secured to a sleeping pad and including on a sheet outer surface thereof first and second sets of multiple discrete sheet fastener elements structurally arranged along corresponding linear or curved first and second sheet attachment paths, wherein:

(c) the first and second attachment paths are structurally arranged generally longitudinally along at least corresponding footward portions of respective first and second lateral edges of the sheet;

(d) the outer and additional sets of discrete quilt fastener elements, the outer and additional quilt attachment paths, the first and second sets of discrete sheet fastener elements, and the first and second sheet attachment paths are structurally arranged so that, with (1) the first and second pairs of bottom fastener elements disengaged from each other, (2) the inner and outer sets of quilt fastener elements disengaged from each other, and (3) the quilt in a footbox-expanded arrangement and positioned with the quilt inner surface facing the sheet outer surface, (i) the outer and additional quilt-overlap areal segments face corresponding portions of the sheet outer surface, (ii) each discrete quilt fastener element of the outer set is substantially aligned with a corresponding, mating, discrete sheet fastener element of the first set, (iii) each discrete quilt fastener element of the additional set is substantially aligned with a corresponding, mating, discrete sheet fastener element of the second set, and (iv) engagement of the corresponding mating quilt and sheet fastener elements of the respective outer and first sets with each other, and engagement of the corresponding mating quilt and sheet fastener elements of the respective additional and second sets with each other, retain at least a footward portion of the quilt secured to the sheet in the footbox-expanded arrangement; and (e) the draw cord and the quilt are structurally arranged so that, with the quilt retained in the footbox-expanded arrangement by engagement of the corresponding mating discrete quilt and sheet fastener elements of the respective outer and first sets with each other, and engagement of the corresponding mating discrete quilt and sheet fastener elements of the respective additional and second sets with each other, pulling the draw cord gathers the quilt bottom edge to form a closed, expanded footbox of the sleeping bag.

10. The article of claim 9 wherein a topmost discrete quilt fastener element of the inner set is also a topmost discrete quilt fastener element of the additional set.

11. The article of claim 9 wherein (i) each discrete quilt fastener element of the outer and additional sets comprises a cord loop or a hook structurally arranged so as to engage and retain a cord loop, (ii) for each cord loop among the outer and additional sets, the corresponding, aligned, mating, discrete sheet fastener element of the first or second set comprises a hook, and (iii) for each hook among the outer and additional sets, the corresponding aligned, mating, discrete sheet fastener element of the first or second set comprises a cord loop.

12. A method for using the article of claim 9, the method comprising:

(A) positioning the quilt with the quilt inner surface facing the sheet outer surface with (i) the quilt in the footbox-expanded arrangement, (ii) the outer and additional quilt-overlap areal segments face corresponding portions of the sheet outer surface, (iii) each quilt fastener element of the outer set is substantially aligned with a corresponding, mating sheet fastener element of the first set, and (iv) each quilt fastener element of the additional set is substantially aligned with a corresponding, mating sheet fastener element of the second set; and (B) engaging the corresponding mating quilt and sheet fastener elements of the respective outer and first sets with each other, and engaging the corresponding mating quilt and sheet fastener elements of the respective additional and second sets with each other, thereby retaining at least a footward portion of the quilt secured to the sheet in the footbox-expanded arrangement.

13. The method of claim 12, the method further comprising, before part (A), (i) disengaging from each other the first and second pairs of bottom fastener elements, and (ii) disengaging from each other the inner and outer sets of quilt fastener elements.

14. The method of claim 12, the method further comprising, after part (B), pulling the draw cord so as to gather the quilt bottom edge to form the closed, expanded footbox of the sleeping bag.

15. A method for using the article of claim 9, the method comprising:

(A) disengaging from each other the corresponding mating quilt and sheet fastener elements of the outer and first sets, respectively;

(B) disengaging from each other the corresponding mating quilt and sheet fastener elements of the additional and second sets, respectively;

(C) wrapping at least a footward portion of the quilt into the overlapping footbox-wrapped arrangement with (i) the outer quilt-overlap areal segment facing a portion of the quilt inner surface, (ii) the inner quilt-overlap areal segment facing a portion of the quilt outer surface, (iii) the inner and outer quilt attachment paths substantially aligned with each other, and (iv) each quilt fastener element of the inner set substantially aligned with the corresponding, mating quilt fastener element of the outer set;

(D) engaging the first pair of bottom fastener elements with each other and engaging the second pair of bottom fastener elements with each other, thereby retaining at least the quilt bottom edge in the overlapping footbox-wrapped arrangement;

(E) engaging corresponding mating quilt fastener elements of the inner and outer sets with each other, thereby retaining at least a footward portion of the quilt in the overlapping footbox-wrapped arrangement; and (F) pulling the draw cord so as to gather the quilt bottom edge and form the closed, wrapped footbox of the sleeping bag.

16. The article of claim 1 further comprising:

(a) an additional set of one or more quilt fastener elements attached to the quilt outer surface along at least a portion of a linear or curved additional quilt attachment path that extends from the first quilt lateral edge to the first quilt bottom edge lateral segment and defines on the quilt outer surface an additional quilt-overlap areal segment bounded by the additional outer quilt attachment path, the quilt bottom edge, and the first quilt lateral edge; and (b) a sheet structurally arranged to be secured to a sleeping pad and including on a sheet outer thereof first and second sets of one or more sheet fastener elements structurally arranged along corresponding linear or curved first and second sheet attachment paths, wherein:

(c) the first and second attachment paths are structurally arranged along at least corresponding footward portions of respective first and second lateral edges of the sheet;

(d) the outer and additional sets of quilt fastener elements, the outer and additional quilt attachment paths, the first and second sets of sheet fastener elements, and the first and second sheet attachment paths are structurally arranged so that, with (1) the first and second pairs of bottom fastener elements disengaged from each other, (2) the inner and outer sets of quilt fastener elements disengaged from each other, and (3) the quilt in a footbox-expanded arrangement and positioned over the sheet with the quilt inner surface facing the sheet outer surface, (i) the outer and additional quilt-overlap areal segments face corresponding portions of the sheet outer surface, (ii) each quilt fastener element of the outer set is substantially aligned with a corresponding, mating sheet fastener element of the first set, (iii) each quilt fastener element of the additional set is substantially aligned with a corresponding, mating sheet fastener element of the second set, and (iv) engagement of the corresponding mating quilt and sheet fastener elements of the respective outer and first sets with each other, and engagement of the corresponding mating quilt and sheet fastener elements of the respective additional and second sets with each other, retain at least a footward portion of the quilt secured to the sheet in the footbox-expanded arrangement; and (e) the draw cord and the quilt are structurally arranged so that, with the quilt retained in the footbox-expanded arrangement by engagement of the corresponding mating quilt and sheet fastener elements of the respective outer and first sets with each other, and engagement of the corresponding mating quilt and sheet fastener elements of the respective additional and second sets with each other, pulling the draw cord gathers the quilt bottom edge to form a closed, expanded footbox of the sleeping bag.

17. The article of claim 16 wherein:

(i) the inner set of quilt fastener elements comprises a continuous quilt fastener element attached to the quilt inner surface along at least a portion of the inner quilt attachment path;

(ii) the outer set of quilt fastener elements comprises a continuous quilt fastener element attached to the quilt outer surface along at least a portion of the outer quilt attachment path;

(iii) the additional set of quilt fastener elements comprises a continuous quilt fastener element attached to the quilt outer surface along at least a portion of the additional quilt attachment path;

(iv) the first set of sheet fastener elements comprises a continuous sheet fastener element attached to the sheet outer surface along the first sheet attachment path; and (v) the second set of sheet fastener elements comprises a continuous sheet fastener element attached to the sheet outer surface along the second sheet attachment path.

18. The article of claim 17 wherein:

(i) the inner set of quilt fastener elements comprises a half zipper attached to the quilt inner surface along at least a portion of the inner quilt attachment path;

(ii) the outer set of quilt fastener elements comprises a half zipper attached to the quilt outer surface along at least a portion of the outer quilt attachment path;

(iii) the additional set of quilt fastener elements comprises a half zipper attached to the quilt outer surface along at least a portion of the additional quilt attachment path;

(iv) the first set of sheet fastener elements comprises a half zipper attached to the sheet outer surface along the first sheet attachment path; and (v) the second set of sheet fastener elements comprises a half zipper attached to the sheet outer surface along the second sheet attachment path.

19. A method for using the article of claim 16, the method comprising:

(A) positioning the quilt with the quilt inner surface facing the sheet outer surface with (i) the quilt in the footbox-expanded arrangement, (ii) the outer and additional quilt-overlap areal segments face corresponding portions of the sheet outer surface, (iii) each quilt fastener element of the outer set is substantially aligned with a corresponding, mating sheet fastener element of the first set, and (iv) each quilt fastener element of the additional set is substantially aligned with a corresponding, mating sheet fastener element of the second set; and (B) engaging the corresponding mating quilt and sheet fastener elements of the respective outer and first sets with each other, and engaging the corresponding mating quilt and sheet fastener elements of the respective additional and second sets with each other, thereby retaining at least a footward portion of the quilt secured to the sheet in the footbox-expanded arrangement.

20. A method for using the article of claim 1, the method comprising:

(A) wrapping at least a footward portion of the quilt into the overlapping footbox-wrapped arrangement with (i) the outer quilt-overlap areal segment facing a portion of the quilt inner surface, (ii) the inner quilt-overlap areal segment facing a portion of the quilt outer surface, and (iii) each quilt fastener element of the inner set substantially aligned with the corresponding, mating quilt fastener element of the outer set;

(B) engaging the first pair of bottom fastener elements with each other and engaging the second pair of bottom fastener elements with each other, thereby retaining at least the quilt bottom edge in the overlapping footbox-wrapped arrangement with the first and second quilt bottom edge lateral segments overlapping each other;

(C) engaging corresponding mating quilt fastener elements of the inner and outer sets with each other, thereby retaining at least a footward portion of the quilt in the overlapping footbox-wrapped arrangement; and (D) pulling the draw cord so as to gather the quilt bottom edge and form the closed, wrapped footbox of the sleeping bag.

21. An article for use with a sleeping bag, the article comprising:

(a) a sheet structurally arranged to be secured to a sleeping pad;

(b) a first set of one or more sheet fastener elements attached to a sheet outer surface and structurally arranged along a linear or curved first sheet attachment path on the sheet outer surface; and (c) a second set of one or more sheet fastener elements attached to the sheet outer surface and structurally arranged along a linear or curved second sheet attachment path on the sheet outer surface, wherein:

(c) the first and second attachment paths are structurally arranged generally longitudinally along at least corresponding footward portions of respective first and second lateral edges of the sheet;

(d) the first and second sets of sheet fastener elements and the first and second sheet attachment paths are structurally arranged so as to enable (i) the first set of sheet fastener elements and a corresponding first set of quilt fastener elements of a quilt usable as a sleeping bag to engage each other, and (ii) the second set of sheet fastener elements and a corresponding second set of quilt fastener elements of the quilt to engage each other; and (e) the first and second sets of sheet fastener elements and the first and second sheet attachment paths are structurally arranged so that, with the quilt in an unwrapped arrangement with the first and second sets of quilt fastener elements disengaged from each other, and with the quilt positioned over the sheet with a quilt inner surface facing the sheet outer surface, (i) each quilt fastener element of the first set is substantially aligned with a corresponding, mating sheet fastener element of the first set, (iii) each quilt fastener element of the second set is substantially aligned with a corresponding, mating sheet fastener element of the second set, and (iv) engagement of the corresponding mating quilt and sheet fastener elements of the respective first sets with each other, and engagement of the corresponding mating quilt and sheet fastener elements of the respective second sets with each other, retain at least a footward portion of the quilt secured to the sheet in a footbox-expanded arrangement.

22. The article of claim 21 wherein:

(i) the first set of sheet fastener elements comprises a continuous sheet fastener element attached to the sheet outer surface along the first sheet attachment path; and (ii) the second set of sheet fastener elements comprises a continuous sheet fastener element attached to the sheet outer surface along the second sheet attachment path.

23. The article of claim 22 wherein:

(i) the first set of sheet fastener elements comprises a half zipper attached to the sheet outer surface along the first sheet attachment path; and (ii) the second set of sheet fastener elements comprises a half zipper attached to the sheet outer surface along the second sheet attachment path.

24. The article of claim 21 wherein:

(i) the first set of sheet fastener elements comprises a first set of multiple discrete sheet fastener elements attached to the sheet outer surface along the first sheet attachment path; and (ii) the second set of sheet fastener elements comprises a second set of multiple discrete sheet fastener elements attached to the sheet outer surface along the second sheet attachment path.

25. The article of claim 24 wherein (i) each discrete sheet fastener element of the first set comprises a cord loop or a hook structurally arranged so as to engage and retain a cord loop, and (ii) each discrete sheet fastener element of the second set comprises a cord loop or a hook structurally arranged so as to engage and retain a cord loop.

26. The article of claim 21 further comprising:

(a) the quilt usable as a sleeping bag;

(b) the first set of one or more quilt fastener elements attached to the quilt and structurally arranged along a linear or curved first quilt attachment path on the quilt; and (c) the second set of one or more quilt fastener elements attached to the quilt and structurally arranged along a linear or curved second quilt attachment path on the quilt, wherein:

(d) the first and second sets of quilt fastener elements and the first and second quilt attachment paths are structurally arranged so that, with at least a footward portion of the quilt in a foot-box wrapped arrangement, engagement of the first and second sets of quilt fastener elements with each other retains at least a footward portion of the quilt in a footbox-wrapped arrangement; and (e) the first and second sets of quilt fastener elements and the first and second quilt attachment paths are structurally arranged so that, with the quilt in an unwrapped arrangement with the first and second sets of quilt fastener elements disengaged from each other, and with the quilt positioned over the sheet with the quilt inner surface facing the sheet outer surface, (i) each quilt fastener element of the first set is substantially aligned with a corresponding, mating sheet fastener element of the first set, (iii) each quilt fastener element of the second set is substantially aligned with a corresponding, mating sheet fastener element of the second set, and (iv) engagement of the corresponding mating quilt and sheet fastener elements of the respective first sets with each other, and engagement of the corresponding mating quilt and sheet fastener elements of the respective second sets with each other, retain at least a footward portion of the quilt secured to the sheet in a footbox-expanded arrangement.

27. The article of claim 26 further comprising a draw cord engaged with and extending across at least a portion of a bottom, footward edge of the quilt, wherein:

(a) the draw cord and the quilt are structurally arranged so that, with the quilt retained in the footbox-wrapped arrangement by engagement of the first and second sets of quilt fastener elements with each other, pulling the draw cord gathers the quilt bottom edge to form a closed, wrapped footbox of the sleeping bag; and (b) the draw cord and the quilt are structurally arranged so that, with the quilt retained in the footbox-expanded arrangement by engagement of the corresponding mating quilt and sheet fastener elements of the respective first sets with each other, and engagement of the corresponding mating quilt and sheet fastener elements of the respective second sets with each other, pulling the draw cord gathers at least a portion of the quilt bottom edge to form a closed, expanded footbox of the sleeping bag.

28. A method for using the article of claim 26, the method comprising:

(A) positioning the quilt with the quilt inner surface facing the sheet outer surface with (i) the quilt in the footbox-expanded arrangement, (ii) each quilt fastener element of the first set substantially aligned with a corresponding, mating sheet fastener element of the first set, and (iii) each quilt fastener element of the second set substantially aligned with a corresponding, mating sheet fastener element of the second set; and (B) engaging the corresponding mating quilt and sheet fastener elements of the respective first sets with each other, and engaging the corresponding mating quilt and sheet fastener elements of the respective second sets with each other, thereby retaining at least a footward portion of the quilt secured to the sheet in the footbox-expanded arrangement.

29. The method of claim 28, the method further comprising, before part (A), disengaging from each other the quilt fastener elements of the first and second sets.

30. The method of claim 28, the method comprising, after part (B), pulling the draw cord so as to gather at least a portion of the quilt bottom edge to form the closed, expanded footbox of the sleeping bag.

31. The method of claim 28, the method further comprising, after part (B):

(C) disengaging from each other the quilt and sheet fastener elements of the respective first sets;

(D) disengaging from each other the quilt and sheet fastener elements of the respective second sets;

(E) wrapping or folding at least a footward portion of the quilt into the footbox-wrapped arrangement; and (F) engaging with each other the quilt fastener elements of the first and second sets, thereby retaining at least a footward portion of the quilt in the footbox-wrapped arrangement.

32. The method of claim 31, the method comprising, after part (B), pulling the draw cord so as to gather at least a portion of the quilt bottom edge to form a closed footbox of the sleeping bag.

* * * * *